US012006177B2

(12) United States Patent
Orita

(10) Patent No.: US 12,006,177 B2
(45) Date of Patent: Jun. 11, 2024

(54) MEDIUM CONVEYING APPARATUS INCLUDING GUIDE MECHANISM SWINGABLY SUPPORTED ABOUT TWO AXES

(71) Applicant: PFU LIMITED, Kahoku (JP)

(72) Inventor: Shinya Orita, Kahoku (JP)

(73) Assignee: PFU LIMITED, Kahoku (JP)

( * ) Notice: Subject to any disclaimer, the term of this patent is extended or adjusted under 35 U.S.C. 154(b) by 232 days.

(21) Appl. No.: 17/450,946

(22) Filed: Oct. 14, 2021

(65) Prior Publication Data

US 2022/0169456 A1 Jun. 2, 2022

(30) Foreign Application Priority Data

Nov. 30, 2020 (JP) ..... 2020-198619

(51) Int. Cl.
*B65H 3/66* (2006.01)
*B65H 3/06* (2006.01)

(52) U.S. Cl.
CPC ..... *B65H 3/0607* (2013.01); *B65H 3/0623* (2013.01); *B65H 3/66* (2013.01); *B65H 2402/441* (2013.01)

(58) Field of Classification Search
CPC ..... B65H 3/66; B65H 2402/441
See application file for complete search history.

(56) References Cited

U.S. PATENT DOCUMENTS 6,659,450 B2 * 12/2003 Fukasawa ..... B65H 3/5223 271/121
10,450,155 B2 * 10/2019 Suto ..... B65H 3/5223
2009/0087238 A1 4/2009 Furuyama

FOREIGN PATENT DOCUMENTS

JP 10-236689 A 9/1998
JP 2004-276254 A 10/2004
JP 2009-84007 A 4/2009

* cited by examiner

*Primary Examiner* — Howard J Sanders
(74) *Attorney, Agent, or Firm* — LEWIS ROCA ROTHGERBER CHRISTIE LLP

(57) ABSTRACT

A medium conveying apparatus includes medium conveying apparatus includes a housing including a locking portion, a first supporting portion and a second supporting portion, a feed roller, a separation roller located to face the feed roller, and a guide mechanism including a locked portion locked with the locking portion, a first shaft portion supported by the first supporting portion, a second shaft portion supported by the second supporting portion, and a conveyance guide portion to regulate a medium fed between the feed roller and the separation roller. The guide mechanism is swingably supported by the housing about the first shaft portion in a state where the locked portion is locked with the locking portion. The guide mechanism is swingably supported by the housing about the second shaft portion in a state where a locking of the locking portion and the locked portion is released.

11 Claims, 22 Drawing Sheets

MEDIUM CONVEYING APPARATUS INCLUDING GUIDE MECHANISM SWINGABLY SUPPORTED ABOUT TWO AXES

CROSS-REFERENCE TO RELATED APPLICATIONS

This application is based upon and claims the benefit of priority of prior Japanese Patent Application No. 2020-198619, filed on Nov. 30, 2020, the entire contents of which are incorporated herein by reference.

TECHNICAL FIELD

Embodiments discussed in the present specification relate to medium conveyance.

BACKGROUND

Recently, a medium conveying apparatus, such as a scanner, is required to convey media, such as a plastic card or a passport, having various thicknesses. Further, such a medium conveying apparatus is required that the maintenance can be easily performed.

A medium conveying apparatus provided with a conveying path in which a medium is conveyed, a medium guide provided on the conveying path to include a swing support portion, and a support portion in which the swing support portion to swing the medium guide is supported swingably in a contact/separation direction relative to the conveying path is disclosed (Japanese Unexamined Patent Publication (Kokai) No. 2009-84007).

A medium conveying apparatus including a conveying member movably arranged in a vertical direction on a conveying path, to convey a medium, and a guide portion to guide the medium, and to be moved in the vertical direction with a movement of the conveying member in the vertical direction is disclosed (Japanese Unexamined Patent Publication (Kokai) No. 2004-276254).

SUMMARY

According to some embodiments, a medium conveying apparatus includes a housing including a locking portion, a first supporting portion and a second supporting portion, a feed roller, a separation roller located to face the feed roller, and a guide mechanism including a locked portion locked with the locking portion, a first shaft portion supported by the first supporting portion, a second shaft portion supported by the second supporting portion, and a conveyance guide portion to regulate a medium fed between the feed roller and the separation roller. The guide mechanism is swingably supported by the housing about the first shaft portion in a state where the locked portion is locked with the locking portion. The guide mechanism is swingably supported by the housing about the second shaft portion in a state where a locking of the locking portion and the locked portion is released.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
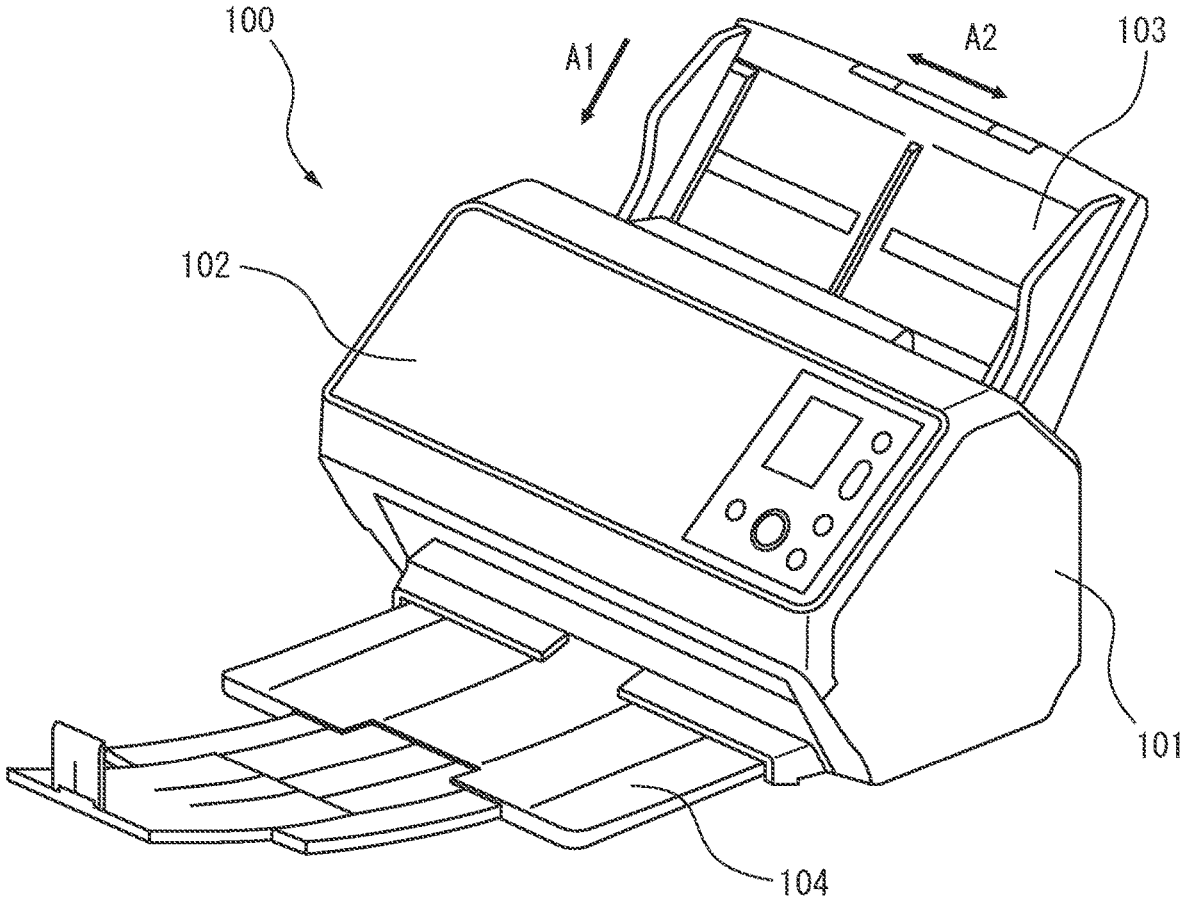
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. The medium is a paper, such as a thin paper, a Plain Paper Copier (PPC) paper, etc., or a thick medium, such as a thick paper, a plastic card, a booklet or a passport (for example, a medium having a thickness larger than 2 mm). In other words, the medium supported by the medium conveying apparatus 100 includes a plurality of media each having a different thickness. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

In FIG. 1, an arrow A1 indicates a medium conveying direction, and an arrow A2 indicates a width direction perpendicular to the medium conveying direction A1. Hereinafter, an upstream refers to an upstream in the medium conveying direction A1, and a downstream refers to a downstream in the medium conveying direction A1.

The medium conveying apparatus 100 includes a lower housing 101, an upper housing 102, a medium tray 103, and an ejection tray 104, etc.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc. The upper housing 102 and the lower housing 101 is formed of a resin material or a metal material, etc. The upper housing 102 is an example of a housing.

The medium tray 103 is engaged with the lower housing 101 in such a way as to be able to place a medium to be conveyed. The ejection tray 104 is engaged with the lower housing 101 in such a way as to be able to hold an ejected medium.

Figure 2:
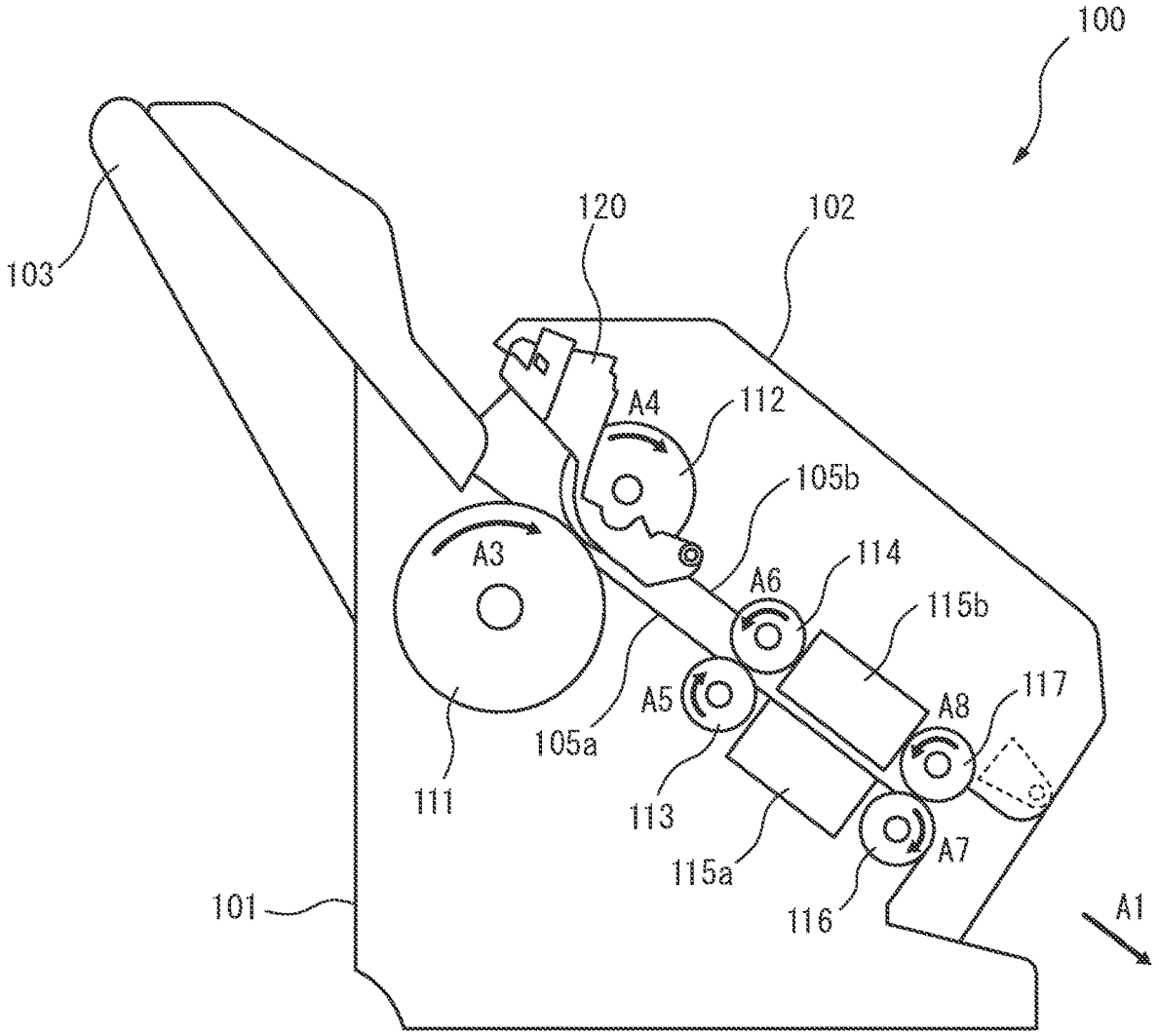
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 include a feed roller 111, a brake roller 112, a first conveyance roller 113, a second conveyance roller 114, a first imaging device 115*a*, a second imaging device 115*b*, a third conveyance roller 116, a fourth conveyance roller 117 and a guide mechanism 120, etc. The number of each roller is not limited to one, and may be plural.

An upper surface of the lower housing 101 forms a lower guide 105*a* forming a lower surface of the medium conveyance path, and a lower surface of the upper housing 102 forms an upper guide 105*b* forming an upper surface of the medium conveyance path.

The feed roller 111 is provided on the lower housing 101 and sequentially feeds media placed on the medium tray 103 from the lower side. The brake roller 112 is an example of a separation roller, is provided on the upper housing 102, and is located to face the feed roller 111.

The first conveyance roller 113 is provided on the lower housing 101. The second conveyance roller 114 is provided on the upper housing 102, and is located to face the first conveyance roller 113 on the upward side of the first conveyance roller 113. The second conveyance roller 114 is urged (pressed) in a direction toward the first conveyance roller 113 side (downward) by a spring (not shown), and is provided movably upward. The first conveyance roller 113 and the second conveyance roller 114 are located on the downstream side of the feed roller 111 and the brake roller 112 in the medium conveying direction A1, and convey the medium fed by the feed roller 111 and the brake roller 112 to the downstream side.

The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an A/D converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from the processing circuit. The second imaging device 115*b* is located to face the first imaging device 115*a* on the upper side of the first imaging device 115*a*, is urged in a direction toward the first imaging device 115*a* side (downward) by a spring (not shown), and is provided movably upward.

Only either of the first imaging device 115*a* and the second imaging device 115*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The third conveyance roller 116 is provided on the lower housing 101. The fourth conveyance roller 117 is provided on the upper housing 102, and is located to face the third conveyance roller 116 on the upward side of the third conveyance roller 117. The fourth conveyance roller 117 is urged in a direction toward the third conveyance roller 116 side (downward) by a spring (not shown), and is provided movably upward. The third conveyance roller 116 and the fourth conveyance roller 117 are located on the downstream side of the first conveyance roller 113 and the second conveyance roller 114 in the medium conveying direction A1, to further convey the medium conveyed by the first conveyance roller 113 and the second conveyance roller 114 to the downstream side.

The guide mechanism 120 is provided at a position overlapping the feed roller 111 and the brake roller 112 in the medium conveying direction A1, in the upper housing 102. The guide mechanism 120 is formed of an integral member, such as a resin material or a metal material, etc. The guide mechanism 120 may be formed of a plurality of members. The guide mechanism 120 abuts against a front end of the medium entering a nip position of the feed roller 111 and the brake roller 112 to regulate floating of the front end of the medium. Further, the guide mechanism 120 regulates the floating of the medium fed between the feed roller 111 and the brake roller 112 so that the medium is appropriately fed between the first imaging device 115*a* and the second imaging device 115*b*.

The medium placed on the medium tray 103 is fed toward the medium conveying direction A1 while being guided by the guide mechanism 120 by the feed roller 111 rotating in a direction of an arrow A3 in FIG. 2, i.e., a medium feeding direction. The medium conveying apparatus 100 has two operation modes: a separation mode in which the medium is separated and fed when a plurality of media is placed on the medium tray 103, and a non-separation mode in which the medium is fed without separating. When operating in the separation mode, the brake roller 112 rotates in a direction of an arrow A4, i.e., in a direction opposite to the media feeding direction, during feeding the medium. By the workings of the feed roller 111 and the brake roller 112, when a plurality of media are placed on the medium tray 103, only a medium in contact with the feed roller 111, out of the media placed on the medium tray 103, is separated. Consequently, conveyance of a medium other than the separated medium is restricted (prevention of multi-feed) On the other hand, when operating in the non-separation mode, the brake roller 112 rotates in an opposite direction of the arrow A4, that is, the medium feeding direction, during feeding the medium.

The medium is fed between the first imaging device 115*a* and the second imaging device 115*b* by the first conveyance roller 113 and the second conveyance roller 114 rotating in directions of an arrow A5 and an arrow A6, respectively. The medium read by the first imaging device 115*a* and the second imaging device 115*b* is ejected on the ejection tray 104 by rotating the third conveyance roller 118 and the fourth conveyance roller 119 in directions of an arrow A7 and an arrow A8, respectively.

Figure 3:
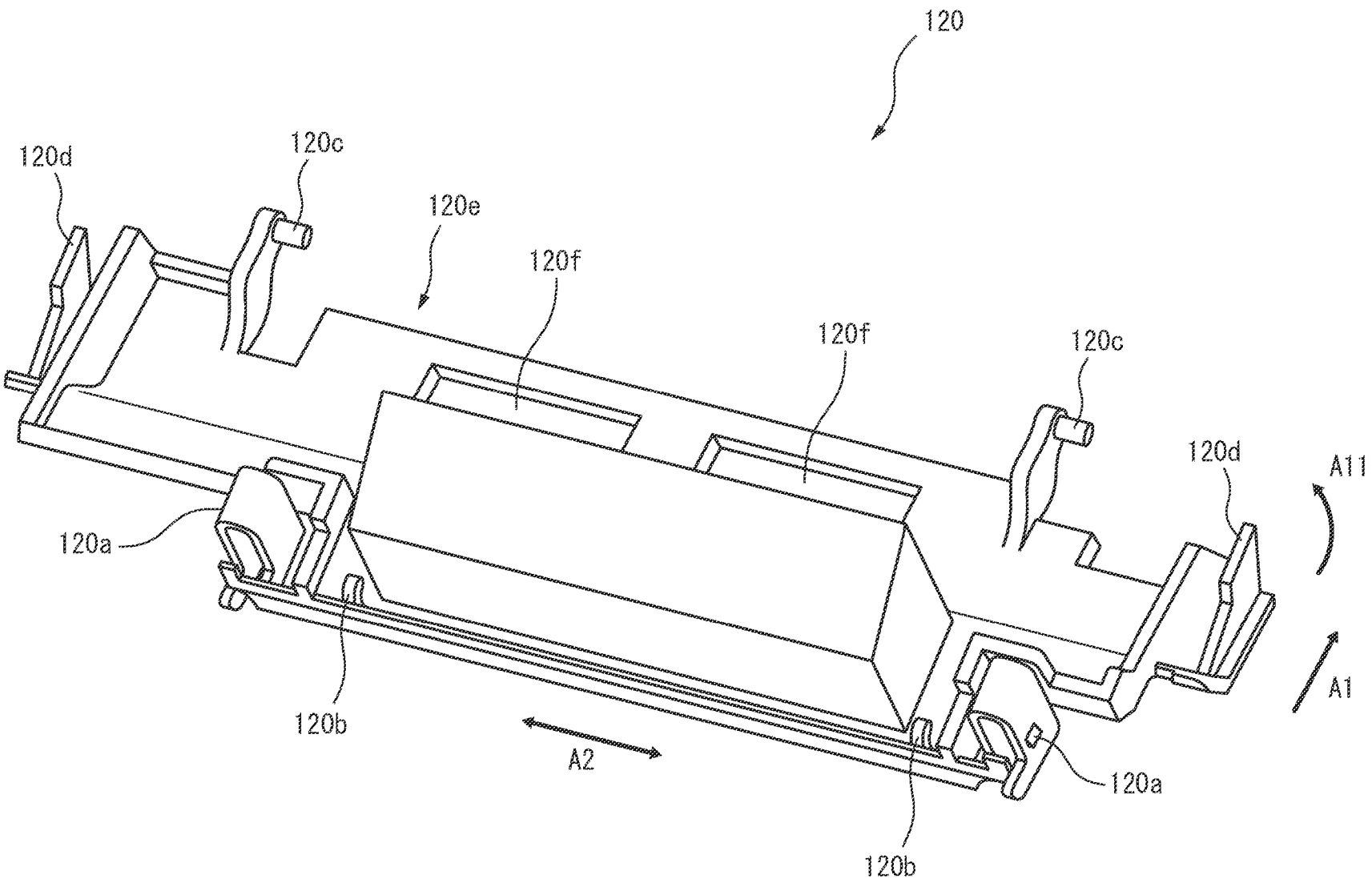
FIG. 3 is a schematic diagram for illustrating a guide mechanism 120.
Figure 4A:
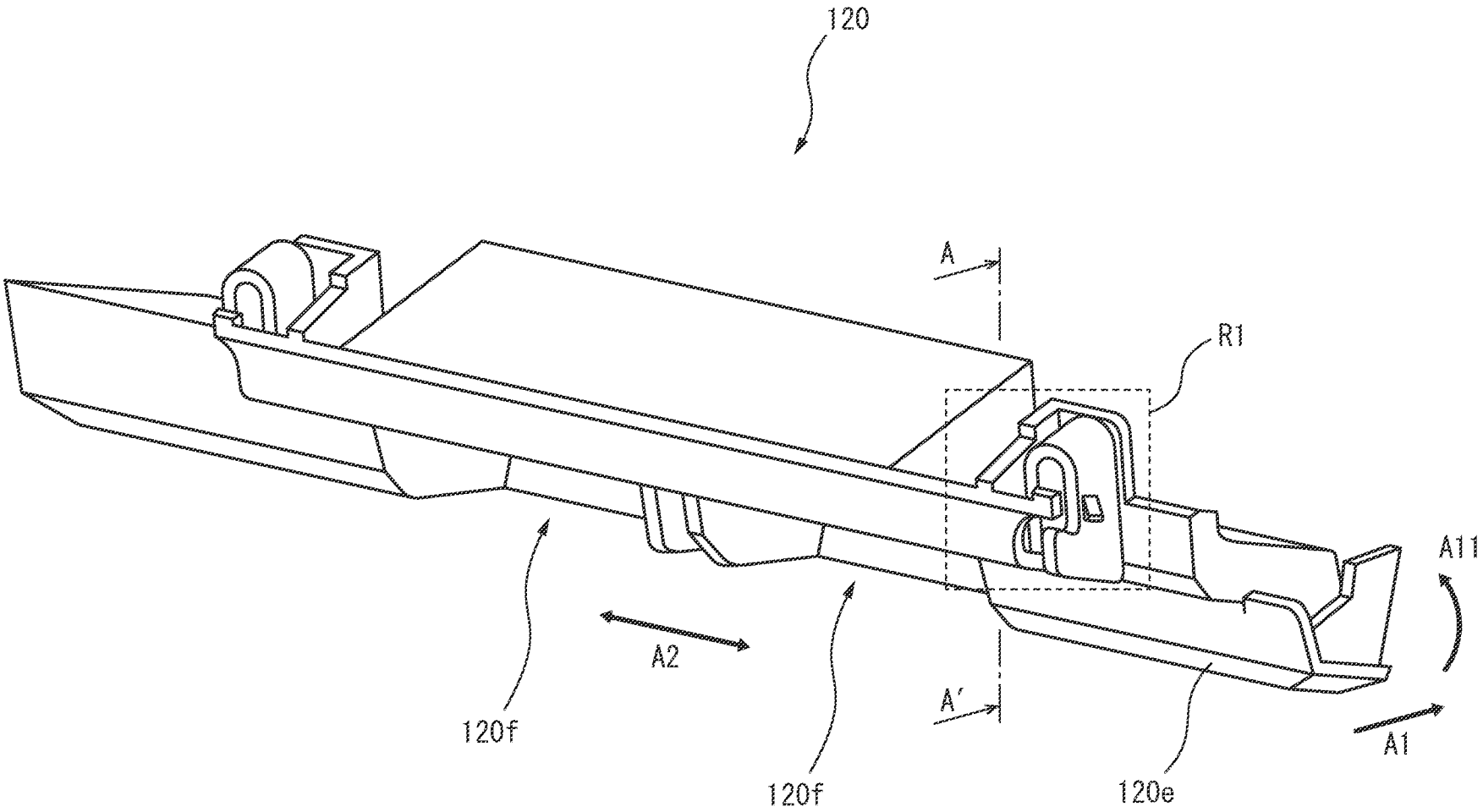
FIG. 4A is a schematic diagram for illustrating the guide mechanism 120.
Figure 4B:
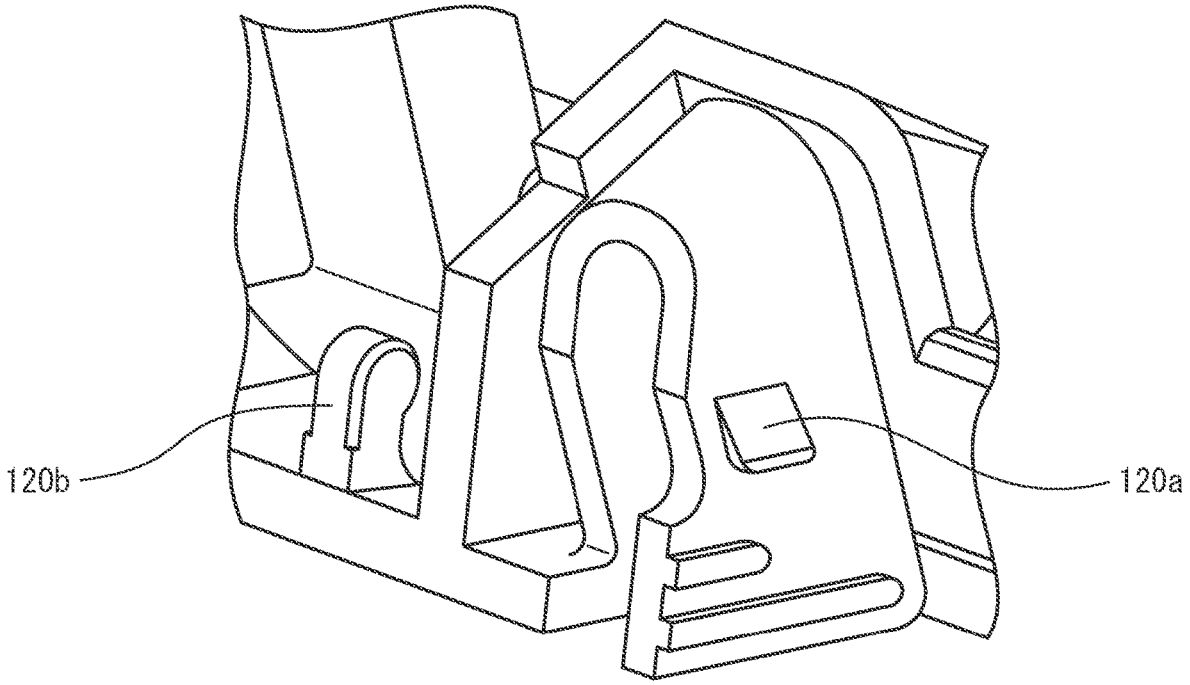
FIG. 4B is a schematic diagram for illustrating a guide mechanism 120.

FIGS. 3, 4A and 4B are schematic diagrams for illustrating the guide mechanism 120. FIG. 3 is a perspective view of the guide mechanism 120 removed from the upper housing 102, as viewed from the upper side (the opposite side of the medium conveyance path). FIG. 4A is a perspective view of the guide mechanism 120 removed from the upper housing 102, as viewed from the upstream side. FIG. 4B is an enlarged view of a cross-sectional view taken along an A-A' line in a portion R1 in FIG. 4A.

As illustrated in FIG. 3, the guide mechanism 120 includes a plurality of locked portions 120*a*, a plurality of first shaft portions 120*b*, a plurality of second shaft portions 120*c*, a plurality of pressed portions 120*d*, a conveyance guide portion 120*e* and an opening portion 120*f*, etc. The locked portions 120*a*, the first shaft portions 120*b*, the second shaft portions 120*c*, the pressed portions 120*d* and the conveyance guide portion 120*e* of the guide mechanism 120 are integrally formed. Thus, the medium conveying apparatus 100 can reduce the number of parts and reduce the equipment cost.

As illustrated in FIGS. 3, 4A and 4B, the locked portions 120*a* are projections (claws) formed on the guide mechanism 120. The locked portions 120*a* are provided at an upstream end portion of the guide mechanism 120 in the medium conveying direction A1, in particular, on the upstream side of the brake roller 112, and located apart from each other along in the width direction A2.

The first shaft portions 120*b* are projections formed in an arc shape. The first shaft portions 120*b* are provided at the upstream end portion of the guide mechanism 120 in the medium conveying direction A1, in particular, on the upstream side of the brake roller 112, and located apart from each other along in the width direction A2.

As illustrated in FIG. 3, the second shaft portions 120*c* are projections formed in an arc shape. The second shaft portions 120*c* are provided at a downstream end portion of the guide mechanism 120 in the medium conveying direction A1, in particular, on the downstream side of the brake roller 112, and located apart from each other along in the width direction A2.

The pressed portions 120*d* have a planar shape. The pressed portions 120*d* are provided at the downstream end portion of the guide mechanism 120 in the medium conveying direction A1, in particular, on the downstream side of the brake roller 112, and located apart from each other along in the width direction A2.

As illustrated in the FIG. 4A, the conveyance guide portion 120*e* is formed on a surface of the guide mechanism 120 on the conveyance path side so as to extend in the width direction A2 except for the opening portion 120*f*.

Figure 5A:
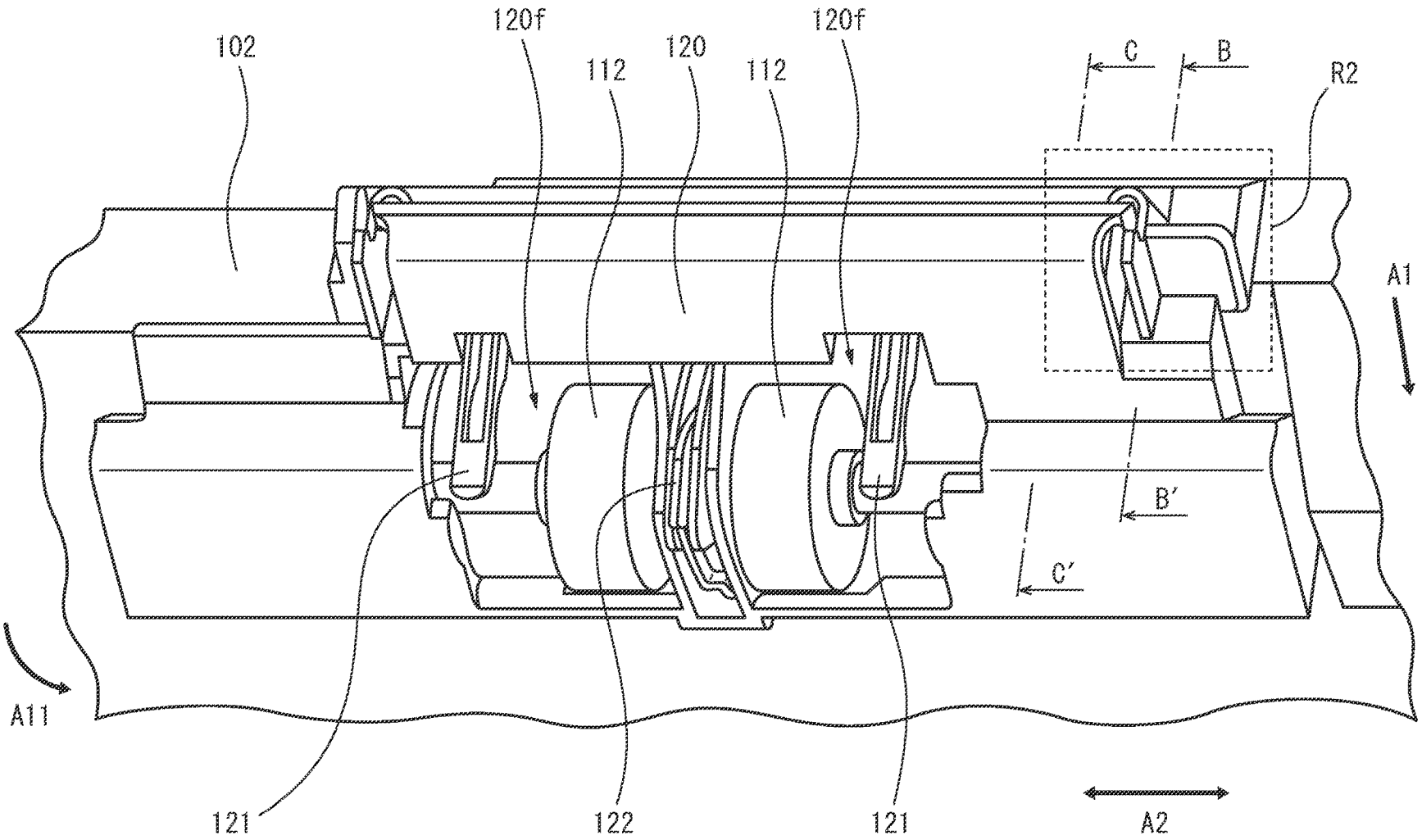
FIG. 5A is a schematic diagram for illustrating the guide mechanism 120.
Figure 5B:
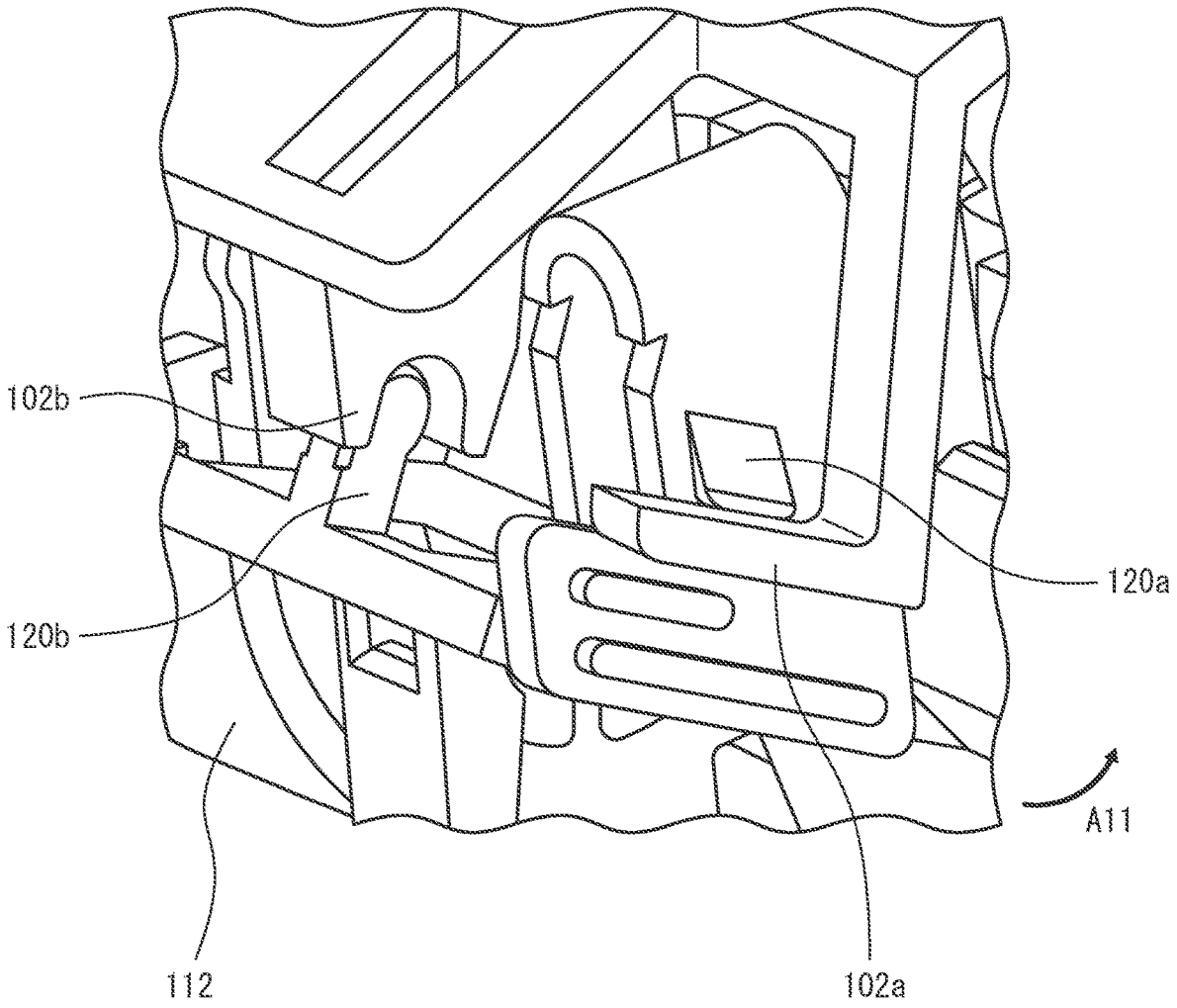
FIG. 5B is a schematic diagram for illustrating the guide mechanism 120.
Figure 6A:
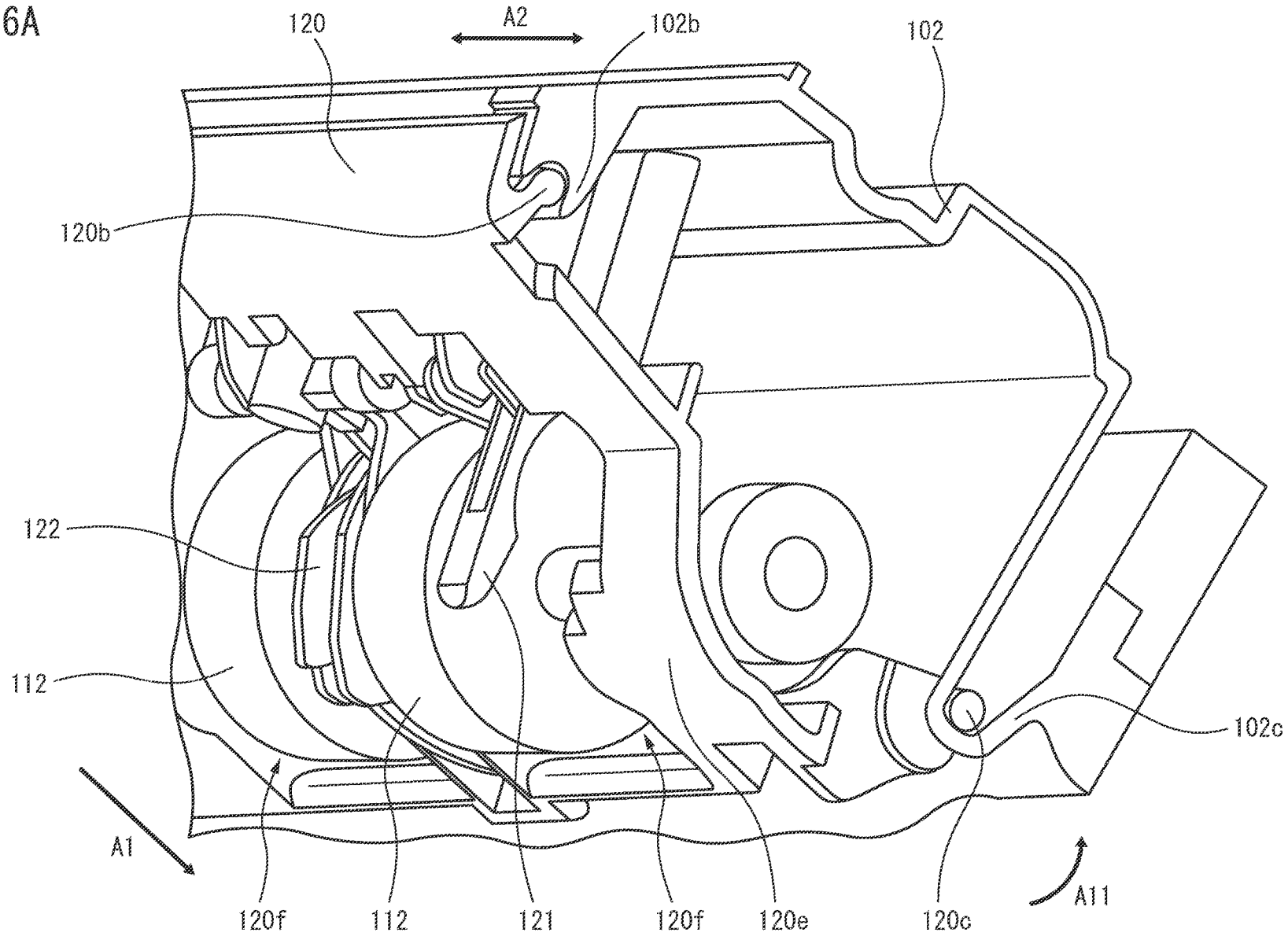
FIG. 6A is a schematic diagram for illustrating the guide mechanism 120.
Figure 6B:
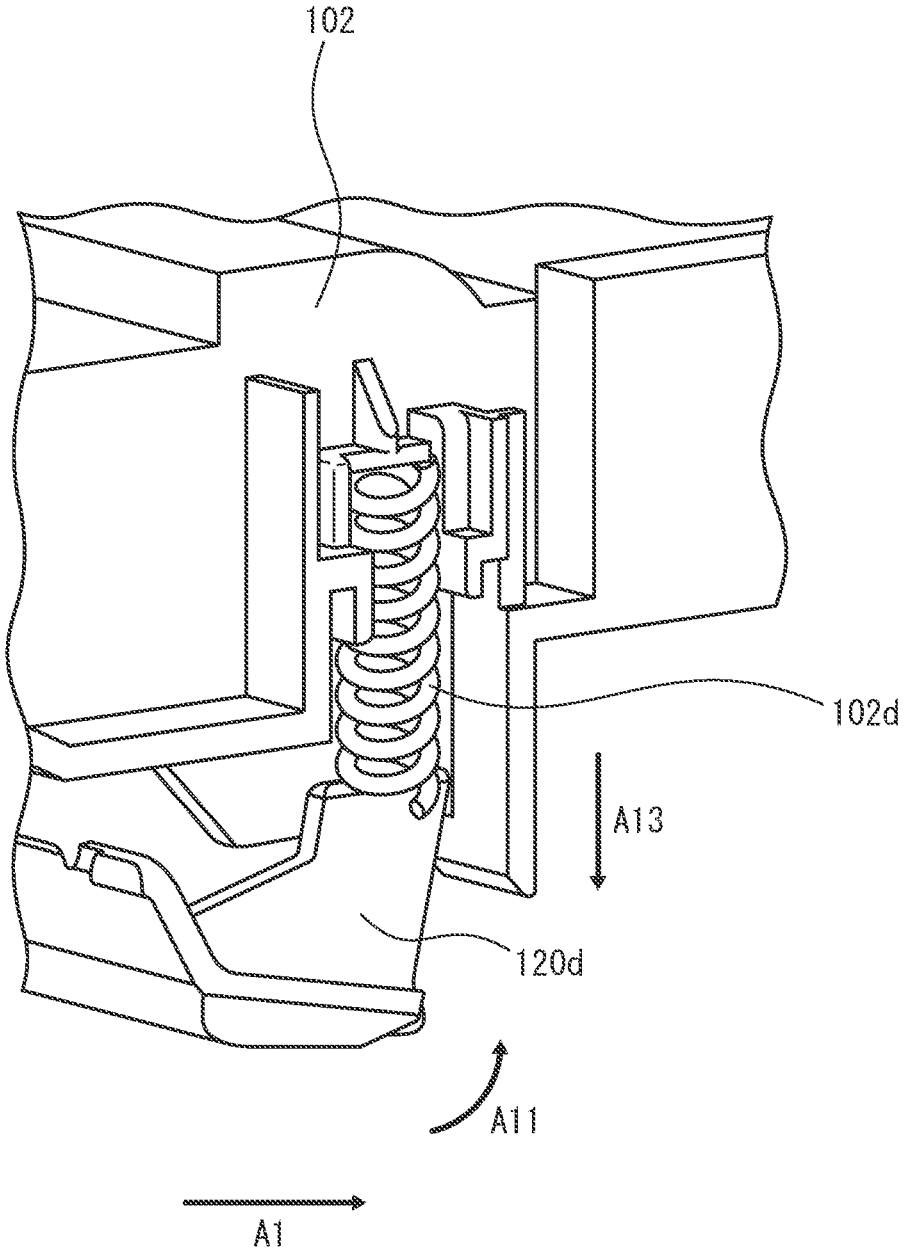
FIG. 6B is a schematic diagram for illustrating the guide mechanism 120.

FIGS. 5A, 5B, 6A and 6B are schematic diagrams for illustrating the guide mechanism 120 in an initial state. FIG. 5A is a perspective view of the guide mechanism 120 attached to the upper housing 102, as viewed from the lower side. FIG. 5B is an enlarged view of a sectional view taken along B-B' line in a portion R2 in FIG. 5A. FIG. 6A is a cross-sectional view taken along C-C' line in FIG. 5A. FIG. 6B is a perspective view of the downstream end portion of the guide mechanism 120 attached to the upper housing 102, as viewed from the side.

As illustrated in FIGS. 5A and 6A, the guide mechanism 120 is attached to the upper housing 102 such that the opening 120*f* faces the braking roller 112. Further, the guide mechanism 120 is provided with a plurality of stoppers 121 and a front end guide 122, etc.

The stoppers 121 are provided on the upstream side of the brake roller 112 in the medium conveying direction A1, and located apart from each other along in the width direction A2. The stoppers 121 abut the front end of the medium placed on the medium tray 103, to prohibit that the medium placed on the medium tray 103 enters the nip position of the feed roller 111 and the brake roller 112, before conveying the medium.

The front end guide 122 is provided on the upstream side of the brake roller 112 in the medium transport direction A1 and between the two brake rollers 112 in the width direction A2. The front end guide 122 is urged downward by a spring (not shown). The front end guide 122 presses the front end of the medium entering the nip position of the feed roller 111 and the brake roller 112 downward to regulate the upward floating of the front end of the medium, during conveyance of the medium. The number of the front end guide 122 is not limited to one, and may be plural. In that case, the front end guides 122 are located apart from each other along in the width direction A2.

As illustrated in FIGS. 5A, 5B, 6A, and 6B, the upper housing 102 includes a plurality of locking portions 102*a*, a plurality of first supporting portions 102*b*, a plurality of second supporting portions 102*c* and pressing members 102*d*, etc.

The locking portions 102*a* are provided at positions facing the locked portions 120*a* in a state where the guide mechanism 120 is attached to the upper housing 102. The locking portions 102*a* have an L-shape to abut the locked portions 120*a*.

The first supporting portions 102*b* are provided at positions facing the first shaft portions 120*b* in a state where the guide mechanism 120 is attached to the upper housing 102. The first supporting portions 102*b* have arc-shaped concave portions along the arc surfaces of the first shaft portions 120*b*, to rotatably support the first shaft portions 120*b*. The first shaft portions 120*b* and the first supporting portions 102*b* are provided so as to contact only at an upper end side of the first shaft portions 120*b* and the lower end side of the first supporting portions 102*b*. Thus, even when a force toward the upper side from the lower side is applied to the guide mechanism 120, the guide mechanism 120 can rotate along the first supporting portions 102*b*, while receiving a load so as not to lift.

The second supporting portions 102*c* are provided at positions facing the second shaft portions 120*c* in a state where the guide mechanism 120 is attached to the upper housing 102. The second supporting portions 102*c* have an arc-shaped concave portion along the arc surface of the second shaft portion 120*c*, and rotatably supports the second shaft portion 120*c* at a lower end of the concave portion.

The pressing members 102*d* are provided at positions facing the pressed portions 120*d* in a state where the guide mechanism 120 is attached to the upper housing 102. The pressing members 102*d* are formed of compression coil springs, and are provided so that one ends thereof are fixed to the upper housing 102 and the other ends thereof contact the pressed portions 120*d*. Thus, the pressed portions 120*d* are urged downward by the pressing members 102*d*. The pressing members 102*d* may be formed of torsion coil springs, or rubber members, etc. The pressing members 102*d* may be held in a predetermined frame so as not to be exposed when the guide mechanism 120 is opened.

As illustrated in FIG. 5B, the locking portions 120*a* are locked with the locked portions 102*a*, in the initial state. Thus, the upstream end portion of the guide mechanism 120 is locked with the upper housing 102, and the guide mechanism 120 is held in the upper housing 102 without falling. Further, the first shaft portions 120*b* are rotatably supported by the first supporting portions 102*b*. As illustrated in FIG. 6B, the pressing members 102*d* press the pressed portions 120*d* downward and press the guiding member 120 to the feed roller 111 side in a state where the locked portions 120*a* are locked with the locking portions 102*a*. On the other hand, as illustrated in FIG. 6A, the second shaft portions 120*c* are rotatably supported by the second supporting portions 102*c* at a lower end of the second supporting portions 102*c* while being movably provided upward in the second supporting portions 102*c*.

Figure 7:
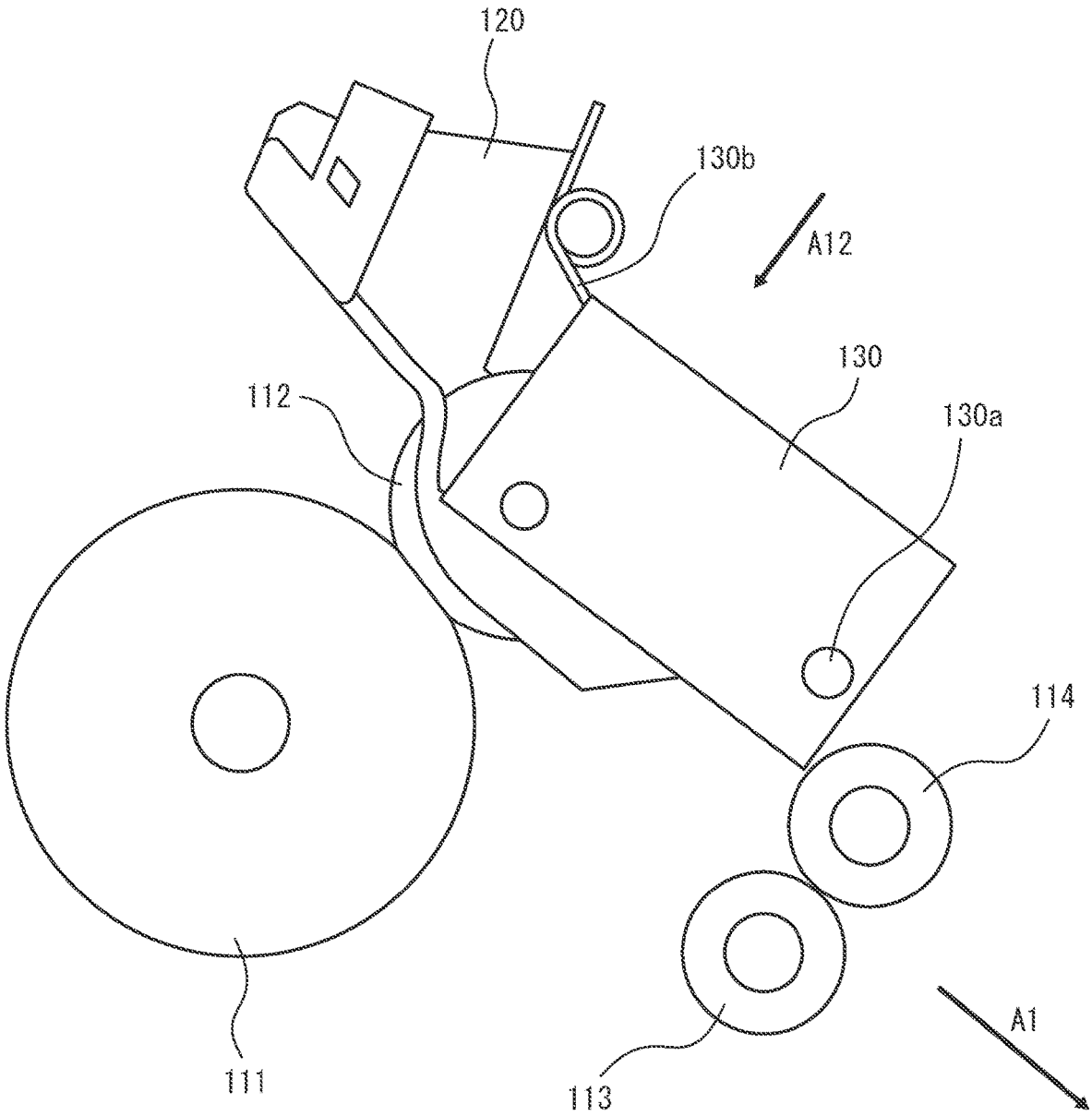
FIG. 7 is a schematic diagram for illustrating a brake roller 112.

FIG. 7 is a schematic diagram for illustrating the brake roller 112.

As illustrated in FIG. 7, the brake roller 112 is provided in a unit 130. A shaft being a rotation shaft of the brake roller 112 is supported by an upstream end portion of the unit 130, and a downstream end portion 130*a* of the unit 130 is swingably (rotatably) supported by the upper housing 102. One end of the spring 130*b*, the other end of which is supported by the upper housing 102, is attached to an upper end of the upstream end portion of the unit 130, and the upstream end portion of the unit 130 is urged by the spring 130*b* in a direction A12 toward the feed roller 111 side.

Figure 8:
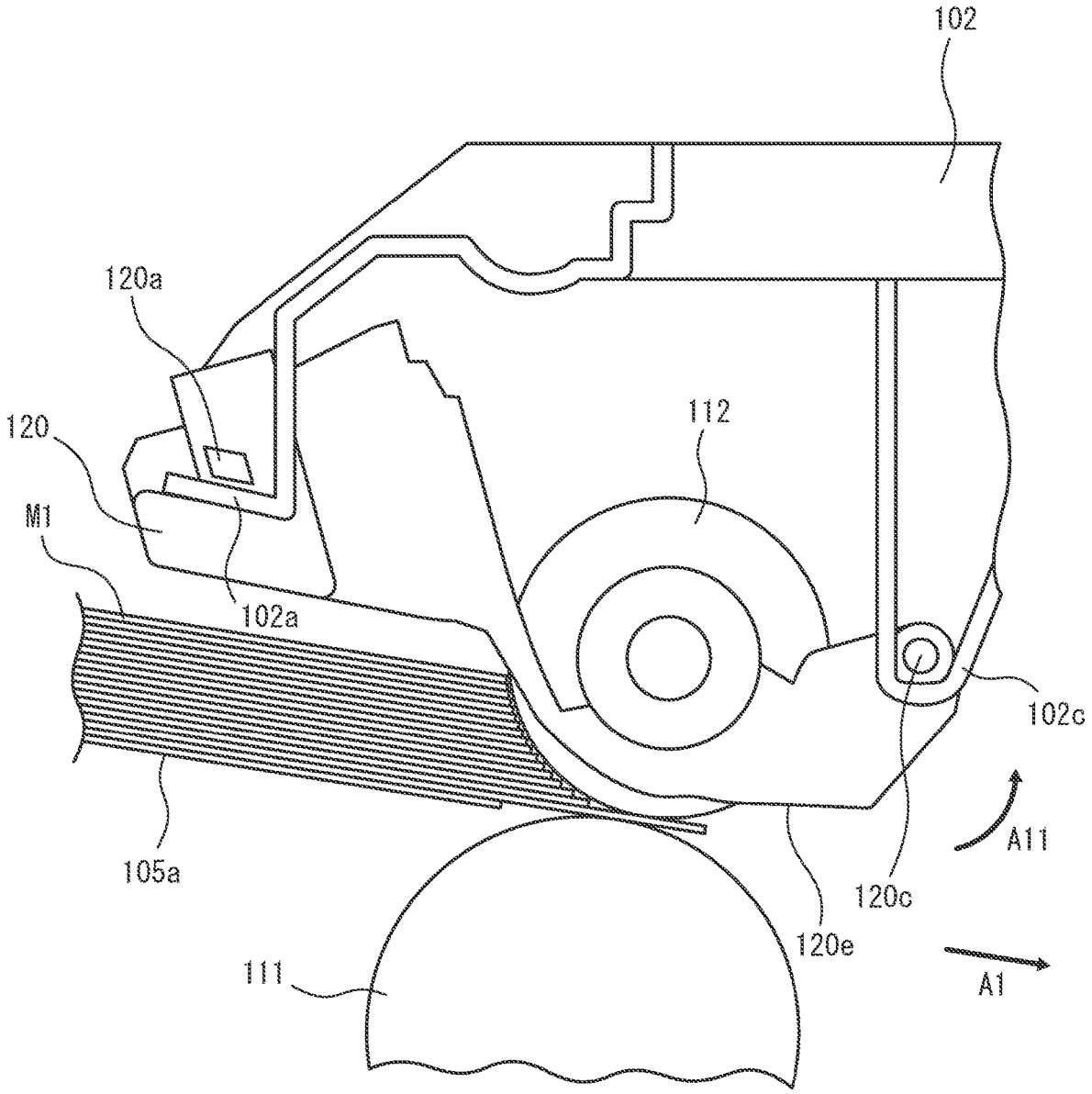
FIG. 8 is a schematic diagram for illustrating a state of the guide mechanism 120.

FIG. 8 is a schematic diagram for illustrating a state of the guide mechanism 120 when a paper is conveyed as the medium (when the medium conveying apparatus 100 operates in the separation mode). FIG. 8 is a schematic diagram of the guide mechanism 120, as viewed from the side.

In the example illustrated in FIG. 8, a plurality of papers M1 are placed on the medium tray 103. A front end of each paper M1 contacts the brake roller 112, and the lowermost paper among the papers M1 is fed to the nip position of the feed roller 111 and the brake roller 112. Since the paper is sufficiently thin, the brake roller 112 hardly moves in a vertical direction with respect to a position before conveyance of the medium, and the unit 130 hardly swings. Further, the papers M1 do not contact the guide mechanism 120, the guide mechanism 120 is pressed downward by the pressing member 102*d* illustrated in FIG. 6B, and the second supporting portion 102*c* stops at a position where the second shaft portion 120*c* contacts a lower end of the second supporting portion 102*c*. That is, the guide mechanism 120 does not change from the initial state. Therefore, the front end guide 122 provided on the upstream side of the guide mechanism 120 is located at an appropriate position without varying in the vertical direction, and each medium is satisfactorily fed by the front end guide 122 when a plurality of media is placed on the medium tray 103. The floating of the paper fed between the feed roller 111 and the brake roller 112 is regulated by the conveyance guide portion 120*e*, and the paper is appropriately conveyed toward the imaging device 115.

Figure 9:
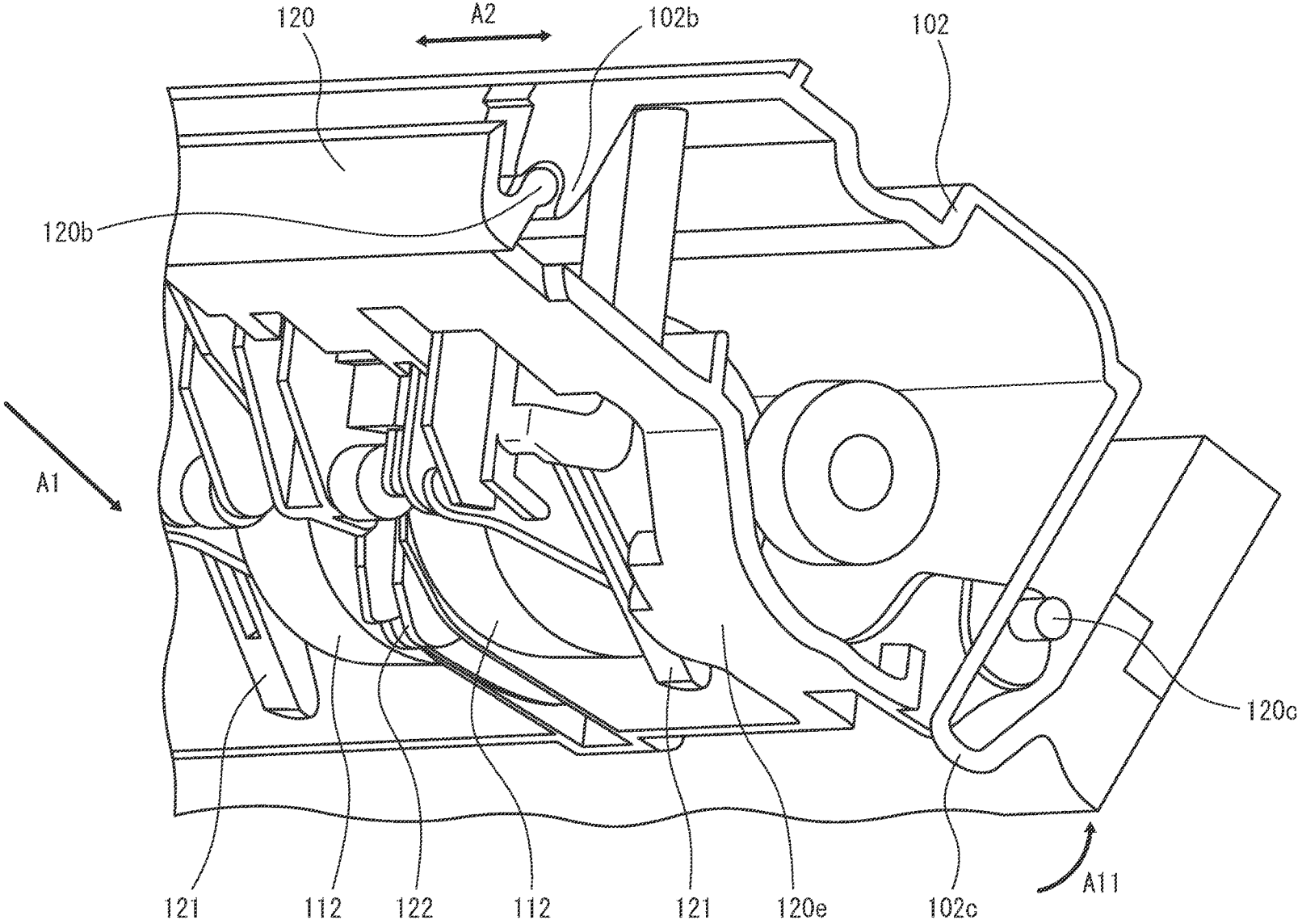
FIG. 9 is a schematic diagram for illustrating the guide mechanism 120.

FIG. 9 is a schematic diagram for illustrating the guide mechanism 120 in a first moving state. FIG. 9 illustrates the guide mechanism 120 which transitions from the initial state illustrated in FIG. 6A to the first moving state.

As illustrated in FIG. 9, when the conveyance guide portion 120*e* is pushed upward from a lower side, the pressed portion 120*d* illustrated in FIG. 6B pushes up the pressing member 102*d*, and the second shaft portion 120*c* rises up with respect to the second supporting portion 102*c*. On the other hand, the first shaft portion 120*b* rotates along the first supporting portion 102*b*. Thus, in the first moving state, the guide mechanism 120 (on a side of the second shaft portion 120*c* located on the downstream side) swings (rotates) about the first shaft portion 120*b* located on the upstream side as a swing axis (rotation axis). As a result, a distance between the feed roller 111 and the conveyance guide portion 120*e* changes. For example, the guide mechanism 120 is located such that a distance between the lower guide 105*a* and the conveyance guide portion 120*e* is about 2 mm in the initial state, and the distance between the lower guide 105*a* and the conveyance guide portion 120*e* is about 8 mm in the first moving state. In this manner, the guide mechanism 120 is swingably supported by the upper housing 102 about the first shaft portion 120*b* so that a distance between the feed roller 111 and the conveyance guide portion 120*e* is variable in a state where the locked portion 120*a* is locked with the locking portion 102*a*.

Figure 10:
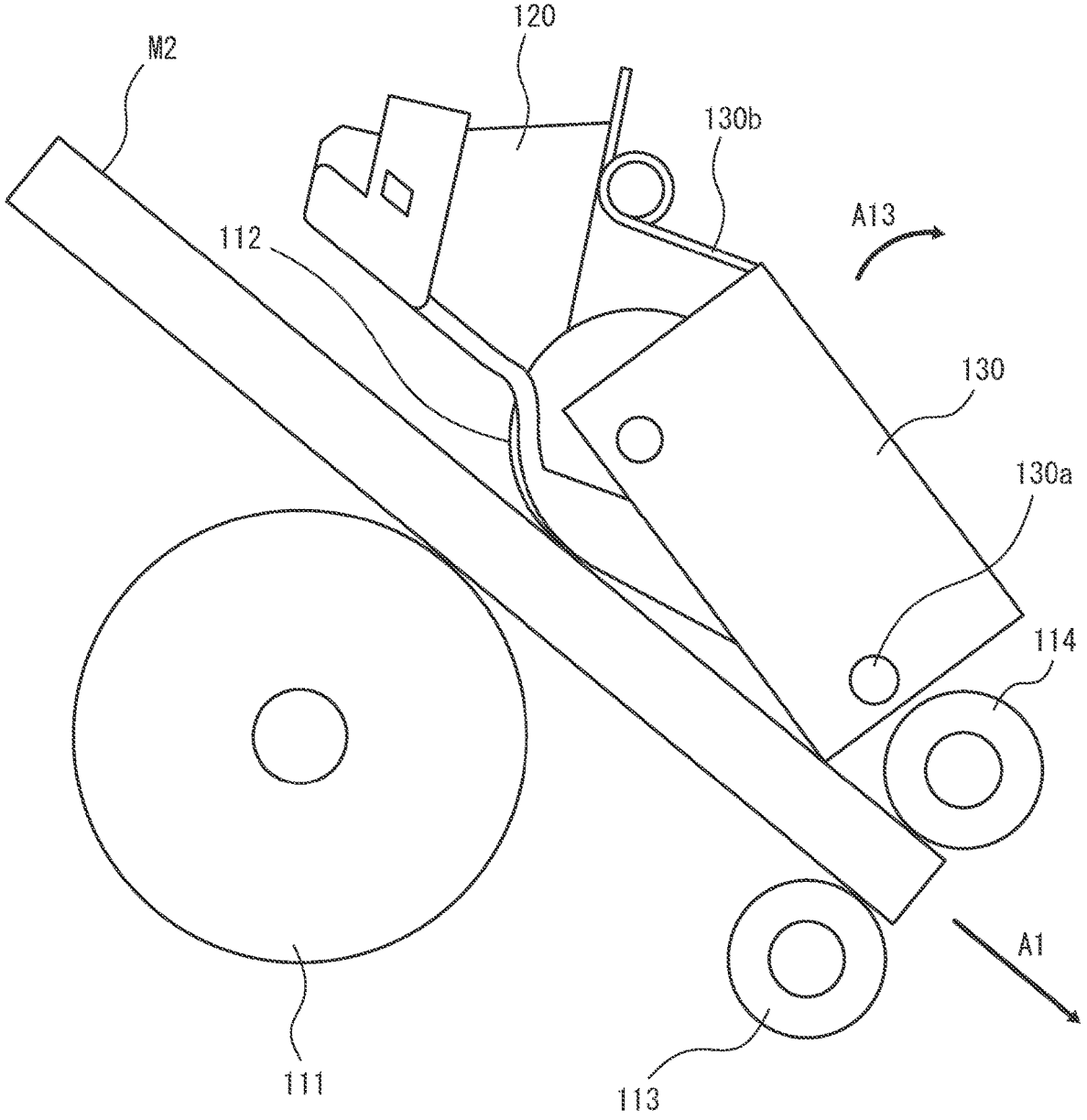
FIG. 10 is a schematic diagram for illustrating a state of the brake roller 112.

FIG. 10 is a schematic diagram for illustrating a state of the brake roller 112 when a thick medium such as a passport is conveyed (when the medium conveying apparatus 100 operates in the non-separation mode). FIG. 10 illustrates the brake roller 112 moved from the state illustrated in FIG. 7.

In the example illustrated in FIG. 10, a passport M2 is fed. As described above, the unit 130 is swingably supported by the upper housing 102. As shown in FIG. 10, since the passport M2 has thickness and rigidity, the brake roller 112 is pushed up by the passport M2, and the upstream end portion of the unit 130 pushes the spring 130*b* upward. Since the downstream end portion 130*a* of the unit 130 is supported by the upper housing 102, the unit 130 swings in a direction of an arrow A13.

Figure 11:
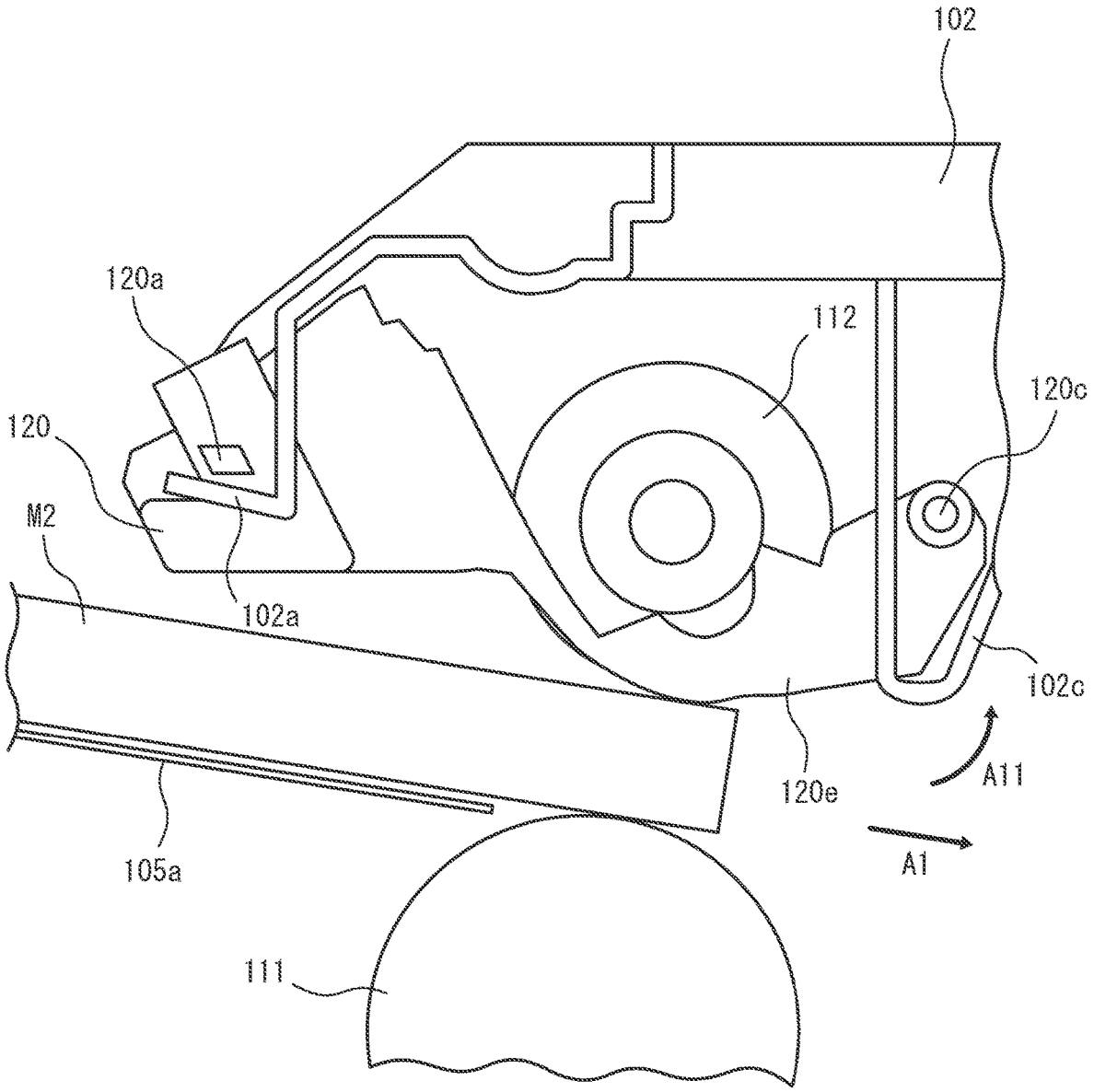
FIG. 11 is a schematic diagram for illustrating the state of the guide mechanism 120.
Figure 12:
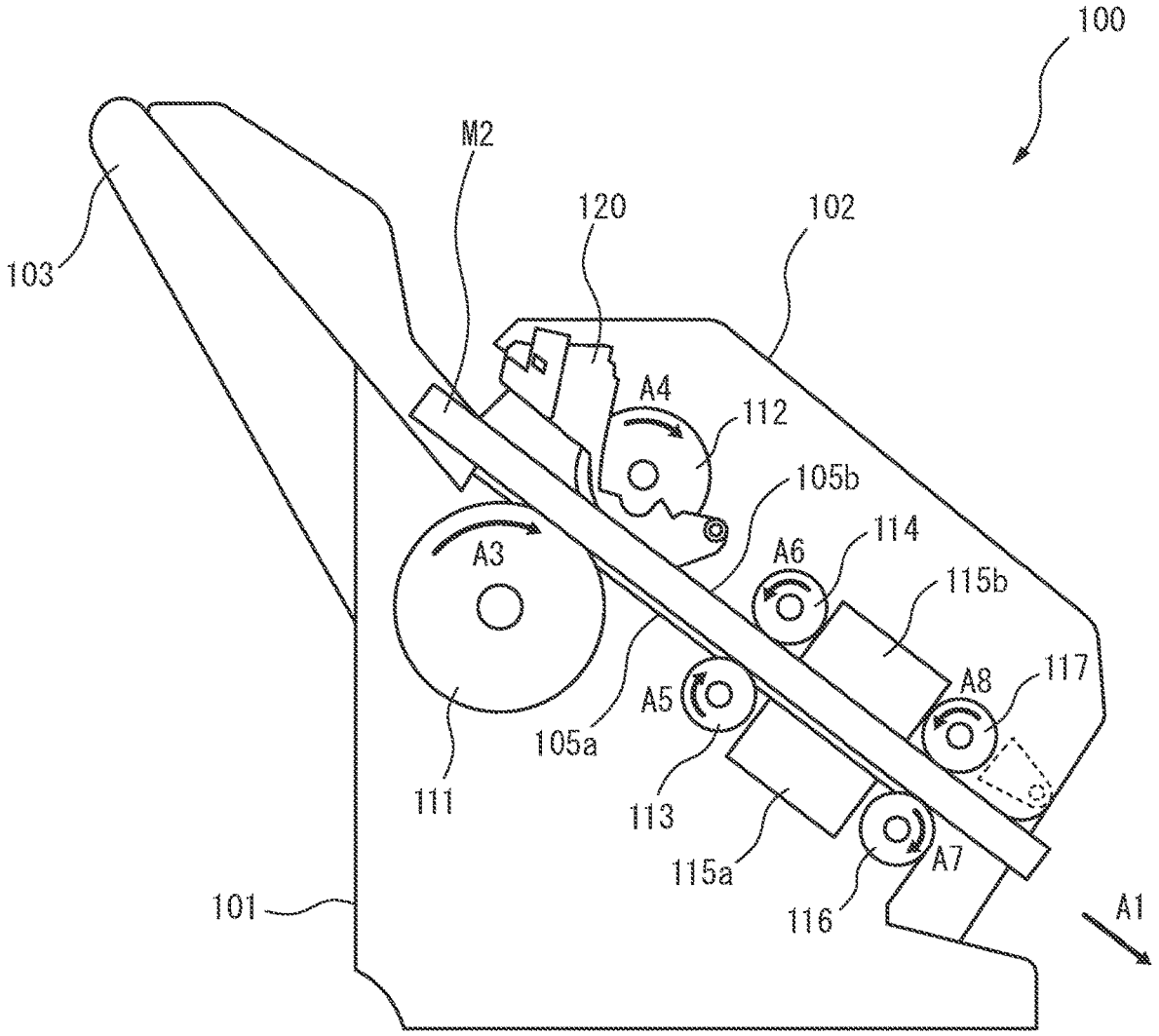
FIG. 12 is a schematic diagram for illustrating the state of the guide mechanism 120.

FIGS. 11 and 12 are a schematic diagrams for illustrating the state of the guide mechanism 120 when the passport M2 is conveyed. FIG. 11 is a schematic diagram of the guide mechanism 120 in the first moving state, as viewed from the side in the same manner as in FIG. 8. FIG. 12 illustrates the guide mechanism 120 which transitions from the initial state illustrated in FIG. 2 to the first moving state.

As described above, when the passport M2 is fed, the brake roller 112 is pushed up by the passport M2. Thus, as illustrated in FIG. 11, the passport M2 contacts the conveyance guide portion 120*e* of the guide mechanism 120, and the conveyance guide portion 120*e* is pushed up by the passport M2. As described with reference to FIG. 9, when the conveyance guide portion 120*e* is pushed up, the pressed portion 120*d* pushes up the pressing member 102*d*, and the second shaft portion 120*c* rises up with respect to the second supporting portion 102*c*. On the other hand, the first shaft portion 120*b* rotates along the first supporting portion 102*b*, and the guide mechanism 120 swings about the first shaft portion 120*b* as a swing axis. In this manner, the guide mechanism 120 is swingably supported by the upper housing 102 about the first shaft portion 120*b* in a state where the locked portion 120*a* is locked with the locking portion 102*a*.

As illustrated in FIG. 12, when the passport M2 whose front end has passed through the nip position of the feed roller 111 and the brake roller 112 is further conveyed to the downstream side, the second conveyance roller 114, the second imaging device 115*b* and the fourth conveyance roller 117 are pushed up by the passport M2. Thus, the medium is satisfactorily conveyed and ejected on the ejection tray 104. In this manner, when the thick medium such as the passport M2 is conveyed, a width of the medium conveyance path in the vertical direction becomes large, and the medium is satisfactorily fed without stopping by being pinched between the lower guide 105*a* and the guide mechanism 120. The medium fed between the feed roller 111 and the brake roller 112 is regulated by the conveyance guide portion 120*e*, and is appropriately conveyed toward the imaging device 115.

Figure 13:
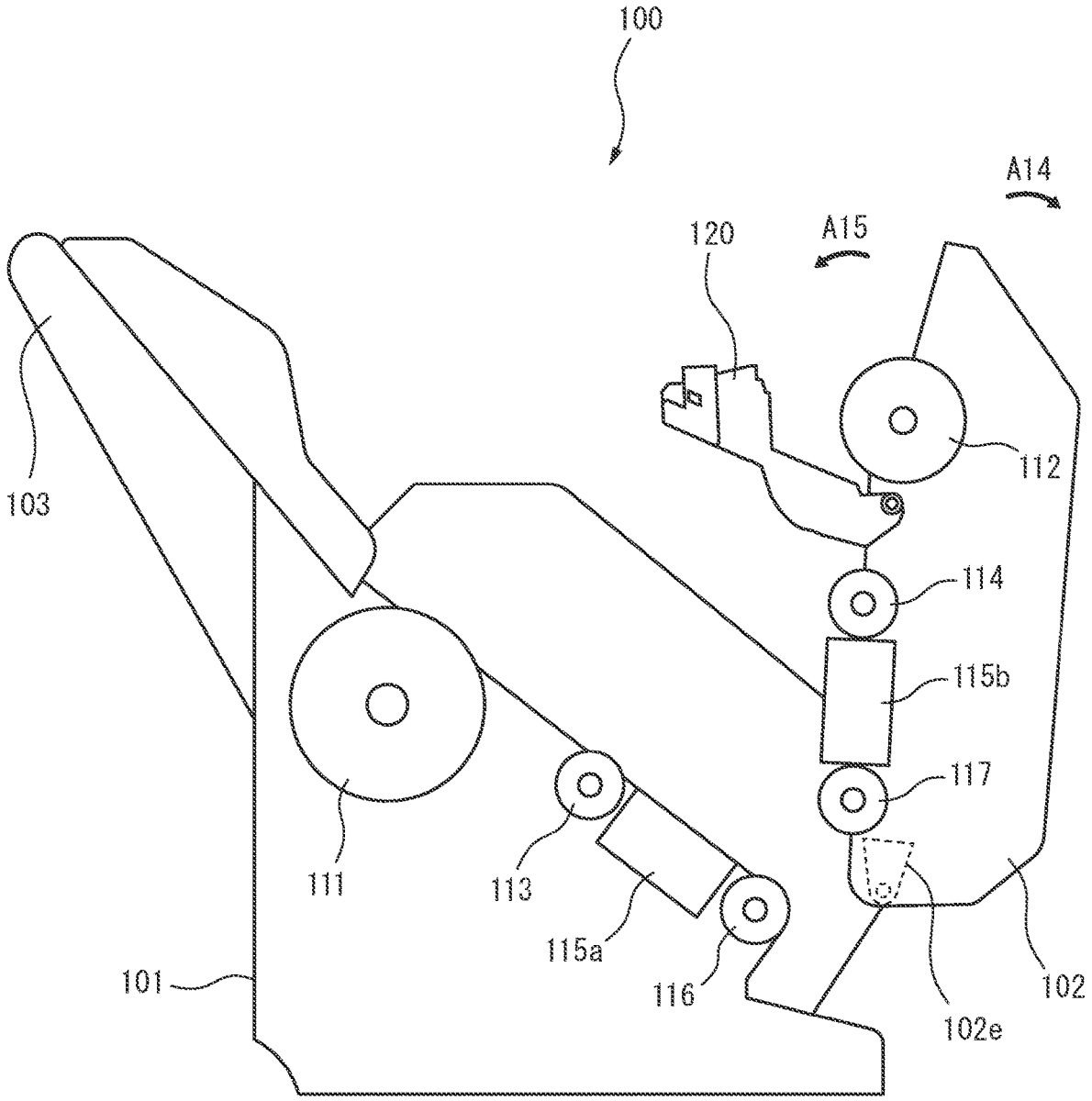
FIG. 13 is a schematic diagram for illustrating the state of the guide mechanism 120.

FIG. 13 is a schematic diagram for illustrating the guide mechanism 120 in a second moving state. FIG. 13 illustrates the guide mechanism 120 which transitions from the initial state illustrated in FIG. 2 to the second moving state.

As illustrated in FIG. 13, the upper housing 102 is swingably (rotatably) supported in a direction of an arrow A14 by the lower housing 101 using a hinge 102*e* provided at a downstream end portion. In a state where the upper housing 102 is open with respect to the lower housing 101, the guide mechanism 120 is allowed to open in a direction of an arrow A15 with respect to the lower housing 101.

Figure 14:
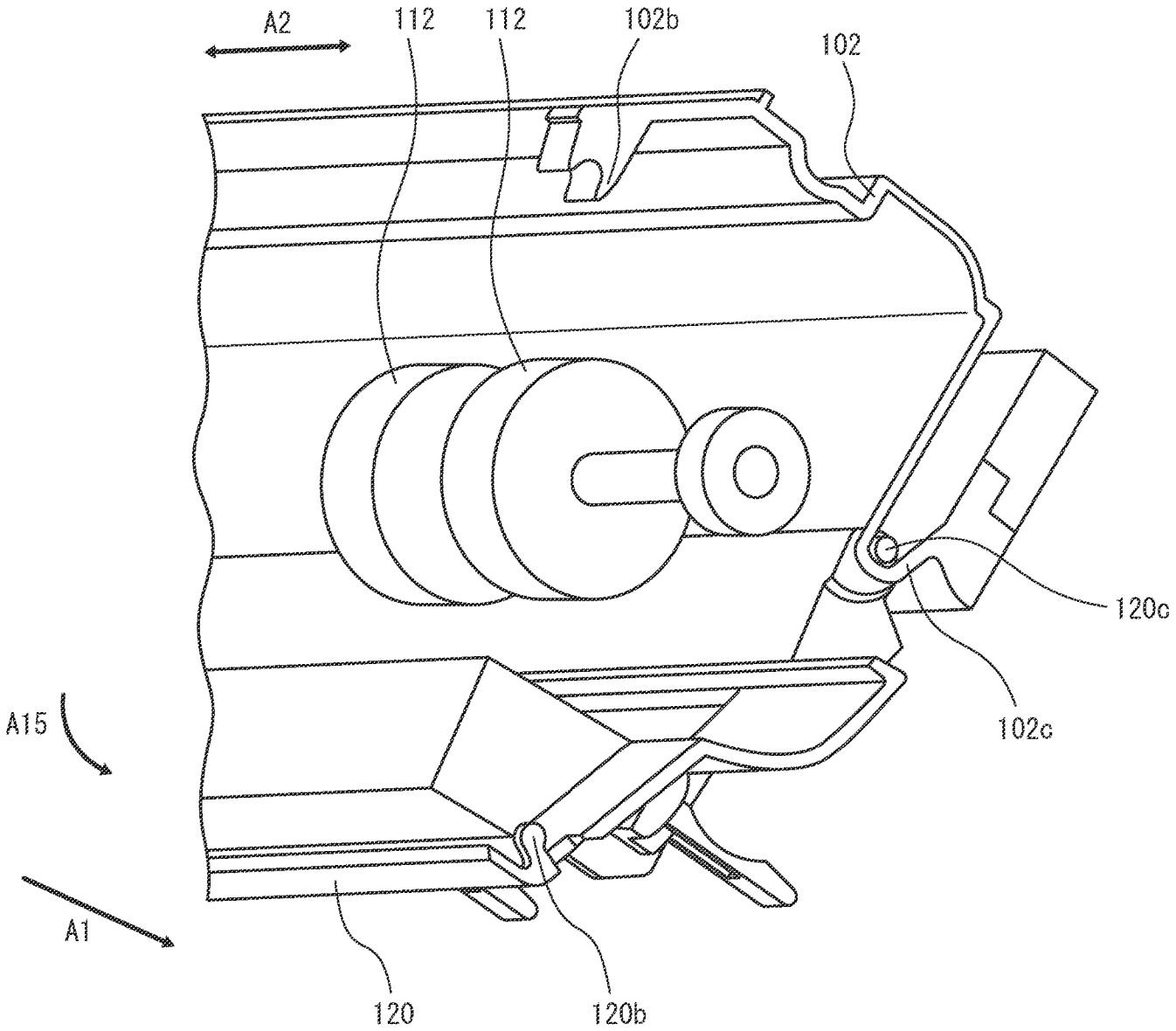
FIG. 14 is a schematic diagram for illustrating the guide mechanism 120.
Figure 15:
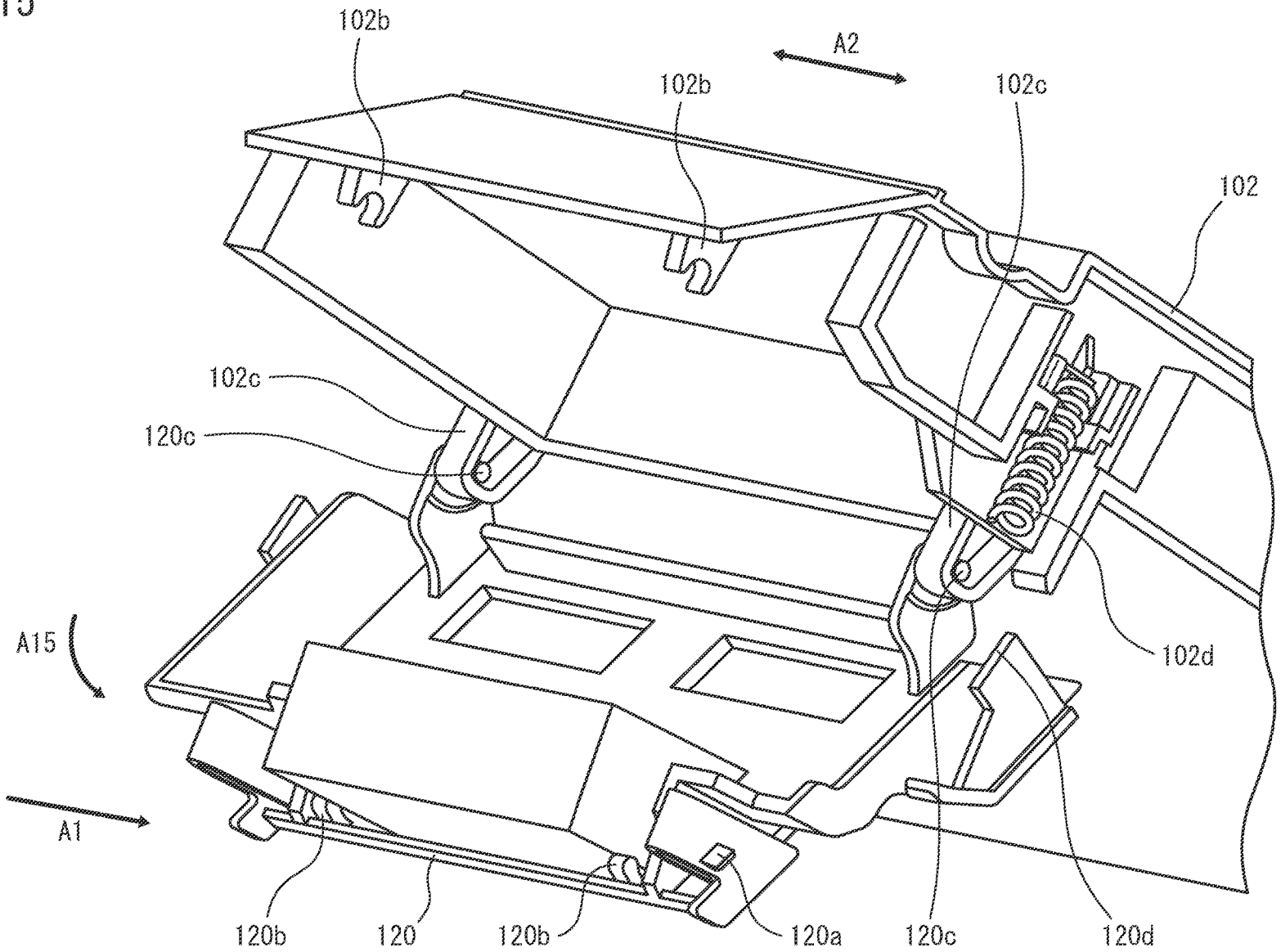
FIG. 15 is a schematic diagram for illustrating the guide mechanism 120.

FIGS. 14 and 15 are schematic diagrams for illustrating the guide mechanism 120 in the second moving state. FIGS. 14 and 15 illustrate the guide mechanism 120 which transitions from the initial state illustrated in FIG. 6A to the second moving state, while the upper housing 102 is opened with respect to the lower housing 101.

As illustrated in FIGS. 14 and 15, when a locking of the locking portion 102*a* and the locked portion 120*a* is released in a state where the upper housing 102 is opened with respect to the lower housing 101, the second shaft portion 120*c* rotates along the second supporting portion 102*c* at the lower end of the second supporting portion 102*c*. Thus, the first shaft portion 120*b* is separated from the first supporting portion 102*b*, and the pressed portion 120*d* is separated from the pressing member 102*d*. As a result, the guide mechanism 120 swings (rotates) in the direction of the arrow A15 about the second shaft portion 120*c* located on the downstream side as the swing axis (rotation axis), and is opened with respect to the lower housing 101, and thereby, the inner side of the guide mechanism 120 is opened. In this manner, the guide mechanism 120 is swingably supported by the upper housing 102 about the second shaft portion 120*c* in order to open the inner side of the guide mechanism 120 in a state where the locking of the locking portion 102*a* and the locked portion 120*a* is released.

As illustrated in FIGS. 14 and 15, the brake roller 112 is located in the upper housing 102 so as to be taken out when the inner side of the guide mechanism 120 is opened. Thus, the user can remove the brake roller 112 from the upper housing 102 in the second moving state, and can easily clean or replace the brake roller 112.

As described in detail above, the medium conveyance apparatus 100 swingably supports the guide mechanism 120 for regulating the fed medium on the housing about the two shaft portions so that the distance between the feed roller 111 and the conveyance guide portion 120*e* is variable and the inner side of the guide mechanism 120 is opened. Thus, the medium conveying apparatus 100 can perform maintenance easily while appropriately conveying a plurality of media having different thicknesses, respectively.

In particular, the medium conveying apparatus 100 can convey a plurality of media having different thicknesses, respectively, by inserting from the same feed port. Further, the medium conveying apparatus 100 can appropriately convey the medium to the imaging device 115 while holding the floating of the medium by the guide mechanism 120. Further, the medium conveying apparatus 100 can protect the brake roller 112 and its driving mechanism against dust by the guide mechanism 120. Further, the guide mechanism 120 can reduce the vertical position variation in the upstream end portion thereof by swinging about the upstream end portion as a swing axis in the initial state and the first moving state. Therefore, the medium conveying apparatus 100 can reduce the vertical position variation of the front end guide 122 provided at the upstream end portion of the guide mechanism 120, and can satisfactorily feed a plurality of media by the front end guide 122 when the plurality of media are placed on the medium tray 103.

Figure 16A:
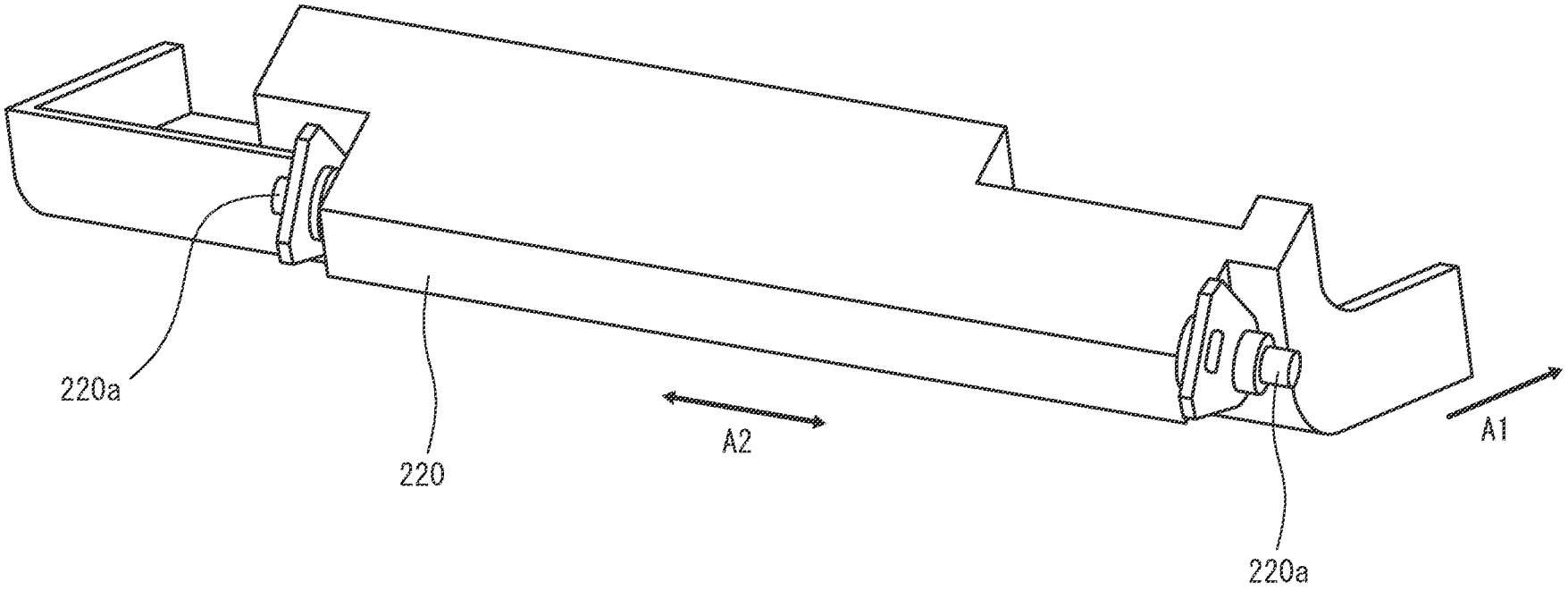
FIG. 16A is a schematic diagram for illustrating another engaged member 220*a*.
Figure 16B:
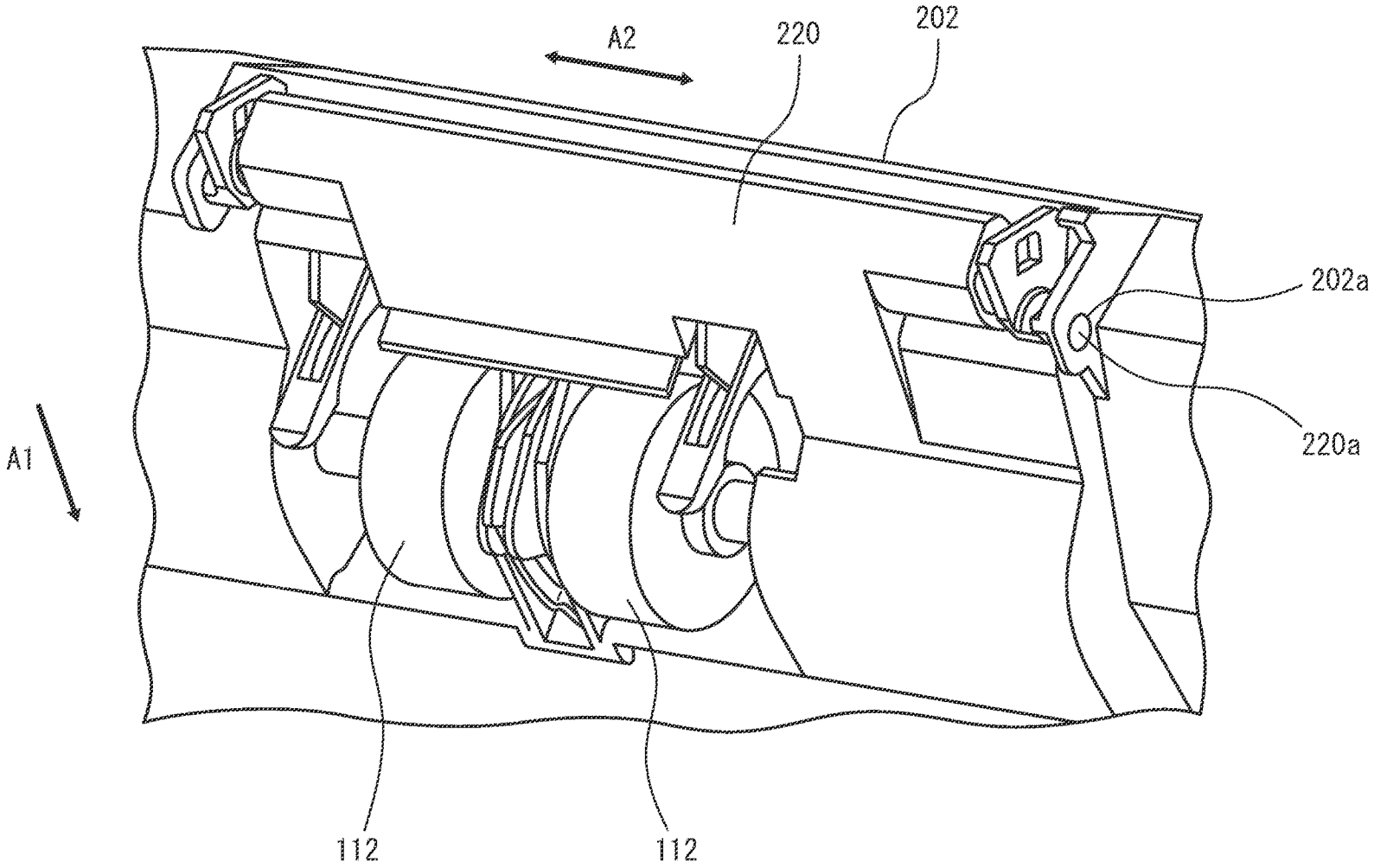
FIG. 16B is a schematic diagram for illustrating the engaged member 220*a*.

FIGS. 16A and 16B are schematic diagrams for illustrating the engaged member 220*a* in a medium conveying apparatus according to another embodiment.

As illustrated in FIGS. 16A and 16B, the medium conveying apparatus according to the present embodiment includes a guide mechanism 220 instead of the guide mechanism 120. The guide mechanism 220 includes a plurality of engaged members 220*a* instead of the plurality of locked members 120*a* and the plurality of first shaft portions 120*b*. Further, as illustrated in FIG. 16B, the medium conveying apparatus according to the present embodiment includes an upper housing 202, instead of the upper housing 102. The upper housing 202 includes engaging portions 202*a* instead of the locking portions 102*a* and the first supporting portions 102*b*.

The engaged members 220*a* are members having a projection formed in a cylindrical shape, are formed separately from the guide mechanism 220, and are attached to the guide mechanism 220. The engaged members 220*a* are urged toward the outside in the width direction A2 with respect to the guide mechanism 220 by a spring (not shown), and are provided so as to be pushed into the inside of the guide mechanism 220. The engaged members 220*a* are provided at an upstream end of the guide mechanism 220 in the medium conveying direction A1, and are located apart from each other along in the width direction A2.

The engaging portions 202*a* are provided at positions facing the projections of the engaged members in a state where the guide mechanism 220 is attached to the upper housing 202. The engaging portions 202*a* have holes that engages with projections of the engaged members 220*a*, and rotatably supports the engaged members 220*a*.

As illustrated in FIG. 16B, the engaged members 220*a* are engaged with the engaging portions 202*a*, and are rotatably supported by the engaging portions 202*a*. Further, the locking of the engaged members 220*a* and the engagement portion 202*a* is released, by pushing the protrusions of the engaged members 220*a* into the guide mechanisms 220. In this manner, the engaged member 220*a* functions as the locked portion and the first shaft portion. That is, in the medium conveying apparatus according to the present embodiment, the first shaft portion and the locked portion are integrally formed, and the first shaft portion functions as the locked portion. Thus, the medium conveying apparatus can simplify a structure of the guide mechanism 220, and thereby, reduce a manufacturing cost of the apparatus.

As described in detail above, the medium conveying apparatus can perform maintenance easily while appropriately conveying a plurality of media having different thicknesses, respectively, even when the first shaft portion and the locked portion are integrally formed, and the first shaft portion functions as the locked portion.

Figure 17:
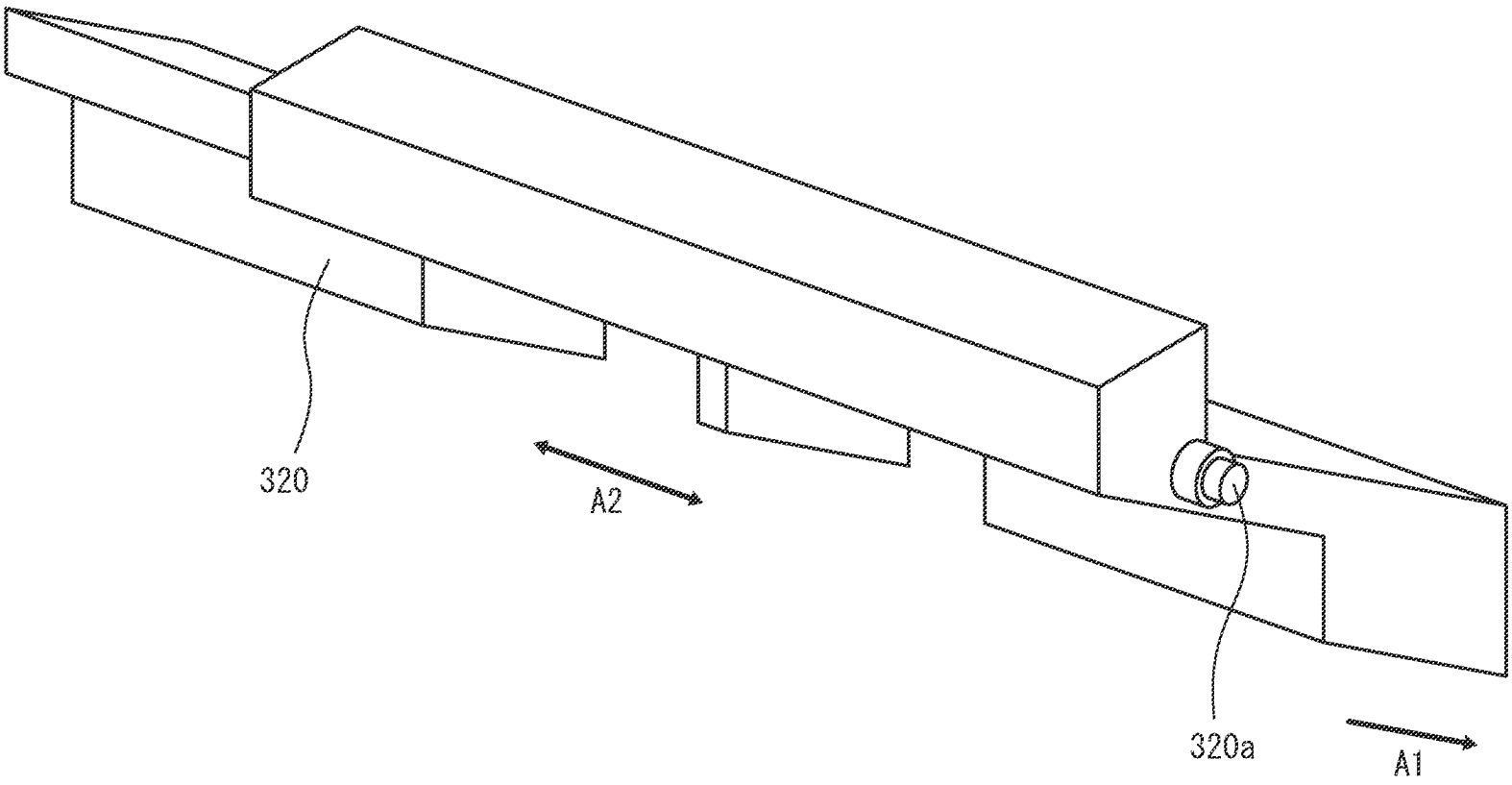
FIG. 17 is a schematic diagram for illustrating still another engaged member 320*a*.

FIG. 17 is a schematic diagram for illustrating the engaged portion 320*a* in a medium conveying apparatus according to still another embodiment.

As illustrated in FIG. 17, the medium conveying apparatus according to the present embodiment includes a guide mechanism 320 instead of the guide mechanism 220 provided with the engaged member 220*a*. The guide mechanism 320 has a plurality of engaged portions 320*a* instead of the plurality of engaged members 220*a*. The medium conveyance apparatus according to the present embodiment includes an upper housing 202 including an engaging portion 202*a*.

The engaged portions 320*a* have projections formed in a cylindrical shape. The engaged portions 320*a* are formed integrally with the guide mechanism 320. The engaged portions 320*a* are located at an upstream end of the guide mechanism 320 in the medium conveyance direction A1, and apart from each other along in the width direction A2.

The engaged portion 320*a* is locked with the engaging portion 202*a*, and rotatably supported by the engaging portion 202*a*. At least one of the guide mechanism 320 and the upper housing 202 has flexibility, and the engaged portion 320*a* is detachably provided to the engaging portion 202*a*. The locking of the engaged portion 320*a* and the engaging portion 202*a* is released, by the engaged portion 320*a* detached from the engaging portion 202*a*. In this manner, the engaged portion 320*a* functions as the engaged portion and the first shaft portion. That is, in the medium conveying apparatus according to the present embodiment, the first shaft portion and the locked portion are integrally formed, and the first shaft portion functions as the locked portion. Thus, the medium conveying apparatus can simplify a structure of the guide mechanism 220, reduce the number of parts, and thereby, reduce the equipment cost and the manufacturing cost of the apparatus.

As described in detail above, the medium conveying apparatus can perform maintenance easily while appropriately conveying a plurality of media having different thicknesses, respectively, even when the first shaft portion and the locked portion are integrally formed, and formed integrally with and the guide mechanism, and the first shaft portion functions as the locked portion.

Figure 18:
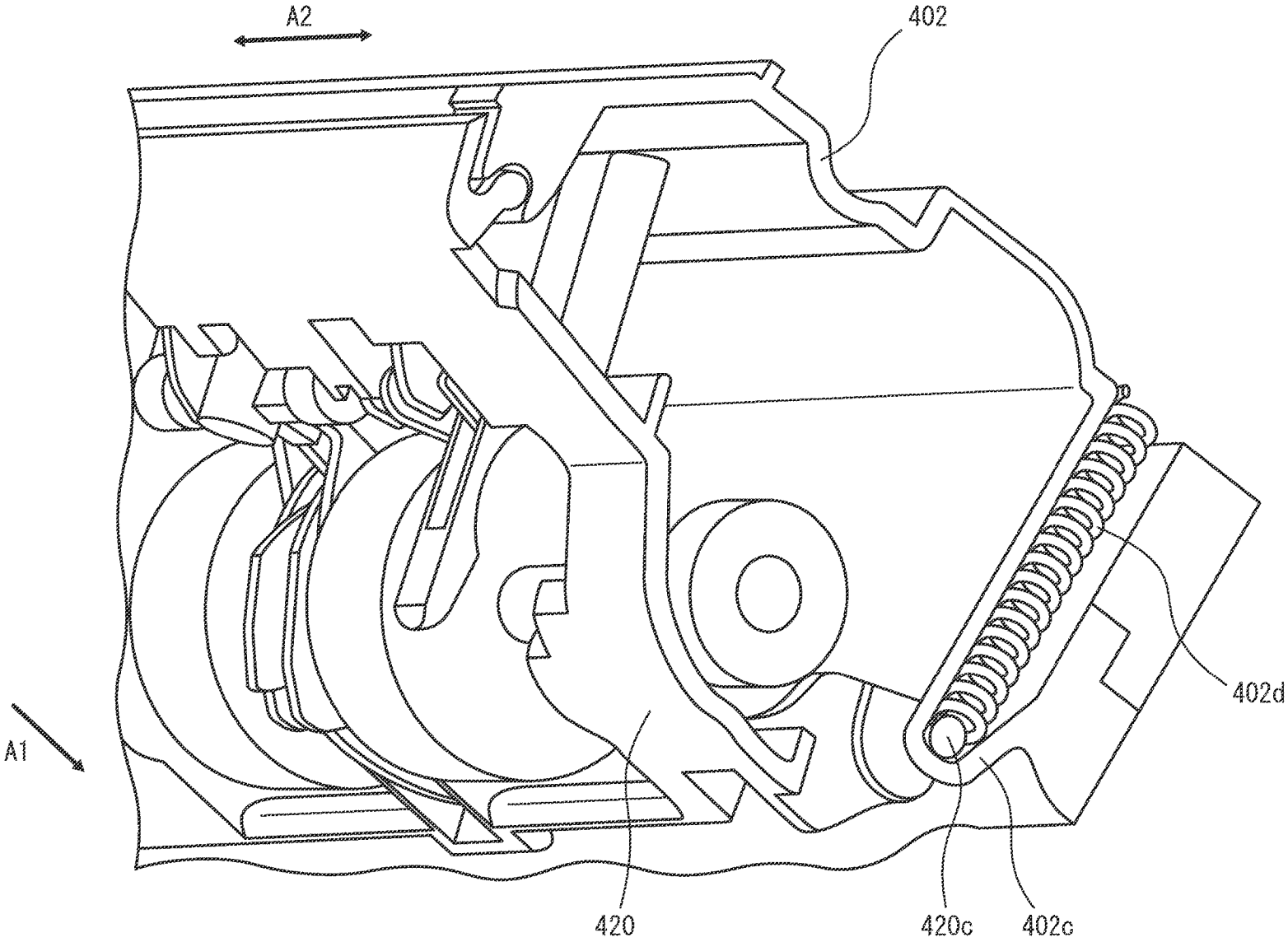
FIG. 18 is a schematic diagram for illustrating still another pressing member 402*d*.

FIG. 18 is a schematic diagram for illustrating a pressing member 402*d* in a medium conveying apparatus according to still another embodiment.

As illustrated in FIG. 18, the medium conveying apparatus according to the present embodiment includes a guide mechanism 420, instead of the guide mechanism 120. The guide mechanism 420 includes a plurality of second shaft portions 420*c*, instead of the plurality of second shaft portions 120*c*. The pressed portion 120*d* is omitted in the guide mechanism 420. Further, the medium conveying apparatus according to the present embodiment includes an upper housing 402, instead of the upper housing 102. The upper housing 402 includes a plurality of second supporting portions 402*c*, instead of the plurality of second supporting portions 102*c*, and includes a plurality of pressing members 402*d*, instead of the plurality of pressing members 102*d*.

The pressing members 402*d* are provided at positions facing the second shaft portions 420*c* in the second supporting portions 402*c*. The pressing members 402*d* are formed of compression coil springs, and are provided so that one ends thereof are fixed to the upper housing 402 and the other ends thereof abut the second shaft portions 420*c*. Thus, the second shaft portions 420*c* are urged downward by the pressing member 402*d*. The pressing member 402*d* may be formed of may be formed of torsion coil springs, or a rubber members, etc.

The pressing members 402*d* function as regulating portions to regulate the second shaft portions 420*c* to swing when the guide mechanism 420 swings about the first shaft portions. Thus, the medium conveying apparatus can simplify a structure of the guide mechanism 420, and thereby, reduce a manufacturing cost of the apparatus.

As described in detail above the medium conveying apparatus can perform maintenance easily while appropriately conveying a plurality of media having different thicknesses, even when the second supporting portion 402*c* is provided with the pressing member 402*d*.

The number of the locked portions 120*a*, the first shaft portions 120*b*, the second shaft portions 120*c* and 420*c*, the pressed portions 120*d*, the locked portions 102*a*, the first supporting portions 102*b*, the second supporting portions 102*c* and 402*c*, the pressing members 102*d* and 402*d*, the stoppers 121, the engaged members 220*a*, the engaged portions 320*a* and/or the engaged portions 202*a* is not limited to two, and may be one or three or more, respectively.

The pressing members 102*d* and 402*d* may be provided on the guide mechanism side, instead of the upper housing side. In this case, for example, the pressing member 102*d* is provided in the pressed portion 120*d*. Alternatively, the pressing member 402*d* is engaged with the second shaft portion 420*c*. In these cases as well, the guide mechanism can swing well.

According to embodiments, the medium conveying apparatus can perform maintenance easily while appropriately conveying a plurality of media having different thicknesses, respectively.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a housing including a locking portion, a first supporting portion and a second supporting portion;

a feed roller;

a separation roller located to face the feed roller; and a guide mechanism including a first shaft portion supported by the first supporting portion, and a second shaft portion supported by the second supporting portion to be locked with the locking portion, and regulate a medium fed between the feed roller and the separation roller, wherein the guide mechanism is supported by the housing in such a way as to be able to swing in a first direction about the first shaft portion in a state where the guide mechanism is locked with the locking portion, and wherein the guide mechanism is supported by the housing in such a way as to be able to swing in a second direction opposite to the first direction about the second shaft portion in a state where a locking of the locking portion and the guide mechanism is released.

2. The medium conveying apparatus according to claim 1, wherein the first shaft portion and a locked portion locked with the locking portion in the guide mechanism are integrally formed.

3. The medium conveying apparatus according to claim 1, wherein the guide mechanism is locked with the locking portion by the first shaft portion locked with the locking portion.

4. The medium conveying apparatus according to claim 1, wherein the first shaft portion and a locked portion locked with the locking portion in the guide mechanism are formed integrally with the guide mechanism.

5. The medium conveying apparatus according to claim 1, wherein the second supporting portion is provided with a pressing member to regulate the second shaft portion to swing when the guide mechanism swings about the first shaft portion.

6. The medium conveying apparatus according to claim 1, further comprising a pressing member to press the guide mechanism to the feed roller side in a state where the locked portion is locked with the locking portion.

7. The medium conveying apparatus according to claim 1, wherein the separation roller is located in the housing so as to be taken out when an inner side of the guide mechanism is opened.

8. The medium conveying apparatus according to claim 1, wherein the first shaft portion and a projection locked with the locking portion in the guide mechanism are integrally formed.

9. The medium conveying apparatus according to claim 1, wherein the first shaft portion and a projection locked with the locking portion in the guide mechanism are formed integrally with the guide mechanism.

10. The medium conveying apparatus according to claim 1, wherein the second supporting portion is provided with a spring or rubber to regulate the second shaft portion to swing when the guide mechanism swings about the first shaft portion.

11. The medium conveying apparatus according to claim 1, further comprising a spring or rubber to press the guide mechanism to the feed roller side in a state where the locked portion is locked with the locking portion.

* * * * *